US006779492B2

(12) United States Patent
Baglione et al.

(10) Patent No.: US 6,779,492 B2
(45) Date of Patent: Aug. 24, 2004

(54) CIRCULATING FLUIDIZED BED REACTOR DEVICE

(75) Inventors: Daniel Baglione, Gentilly (FR); Jean-Claude Semedard, Paris (FR); Pierre Gauville, Verrieres (FR); Jean-Xavier Morin, Neuville Aux Bois (FR); Emmanuel Flores, Le Plessis Robinson (FR); Alain Quaranta, Fontenay les Briis (FR); Christian Bonnand, Bachy (FR)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 10/451,830

(22) PCT Filed: Oct. 29, 2002

(86) PCT No.: PCT/EP02/12066

§ 371 (c)(1),
(2), (4) Date: Jun. 25, 2003

(87) PCT Pub. No.: WO03/038338

PCT Pub. Date: May 8, 2003

(65) Prior Publication Data

US 2004/0065273 A1 Apr. 8, 2004

(30) Foreign Application Priority Data

Oct. 30, 2001 (EP) ..... 01402810

(51) Int. Cl.[7] ..... B09B 3/00

(52) U.S. Cl. ..... 122/4 D; 165/104.16

(58) Field of Search ..... 122/4 D, 7 R; 110/245, 345, 347; 165/104.16

(56) References Cited

U.S. PATENT DOCUMENTS

| | | | | |
|---|---|---|---|---|
| 4,745,884 A | | 5/1988 | Coulthard | |
| 4,809,625 A | | 3/1989 | Garcia-Mallol et al. | |
| 5,215,042 A | | 6/1993 | Beisswenger et al. | |
| 5,553,557 A | * | 9/1996 | Abdulally | 110/345 |
| 5,735,682 A | | 4/1998 | Toth | |
| 5,771,844 A | * | 6/1998 | Dietz | 122/4 D |
| 6,039,008 A | * | 3/2000 | Anderson et al. | 122/510 |
| 6,294,001 B1 | * | 9/2001 | Hyppanen et al. | 95/271 |
| 6,470,833 B1 | * | 10/2002 | Hyppanen | 122/4 D |

FOREIGN PATENT DOCUMENTS

WO WO 99/60305 11/1999

* cited by examiner

*Primary Examiner*—Gregory Wilson
(74) *Attorney, Agent, or Firm*—Cohen, Pontani, Lieberman & Pavane

(57) ABSTRACT

The circulating fluidized bed reactor device comprising a reactor chamber delimited horizontally by walls, a centrifugal separator and a back pass for heat recovery The reactor device allows for the introduction of a fluidizing gas into the reactor chamber and for maintaining a fluidized bed of particles in said chambers. The gas to be dedusted is transferred from the reactor chamber into the separator, and the separated particles are discharged from the separator and the dedusted gas is transferred from the separator into the back pass. The reactor chamber and the separator both have a common wall with the back pass.

40 Claims, 12 Drawing Sheets

CIRCULATING FLUIDIZED BED REACTOR DEVICE

PRIORITY CLAIM

This is a U.S. national stage of application No. PCT/IEP02/12066, filed on 29 Oct. 2002. Priority is claimed on that application and on the following application: Country: EPO, Application No.: 01 402 810.4, Filed: 30 Oct. 2001.

BACKGROUND OF THE INVENTION

1. Field of the Invention

The present invention relates to a circulating fluidized bed reactor device comprising a reactor chamber delimited horizontally by walls, a centrifugal separator and a back pass for heat recovery, the reactor device comprising means for introducing a fluidizing gas into the reactor chamber and for maintaining a fluidized bed of particles in said chamber, means for transferring gas to be dedusted from the reactor chamber into the separator, means for discharging separated particles from the separator and means for transferring dedusted gas from the separator into the back pass, the latter having a common wall with the reactor chamber.

2. Discussion of Related Art

In general, a reactor device is a boiler device where fuel particles (to which sorbent particles are suitably added for sulfur capture) are burnt in the reactor chamber, also named furnace or combustion chamber, and where heat generated is recovered in the back pass, also named pass boiler, so as to produce energy (e.g. for driving electricity production turbines).

U.S. Pat. No. 4,745,884 discloses such a circulating fluidized bed reactor. In this reference, the reactor chamber and the back pass are contained within an upstanding, generally rectangular shaped waterwall structure. Therefore, the assembly of the reactor chamber and the back pass is compact.

However, U.S. Pat. No. 4,745,884 discloses the reactor comprising two separators, respectively disposed on each side of the structure containing the reactor chamber and the back pass and situated at a distance from said structure. These separators have generally circular cross sections and are connected to the reactor chamber and to the back pass by external ducts.

Consequently, despite the compact constitution of the reactor chamber and the back pass, the reactor is not compact due to the disposition of the separators.

OBJECTS AND SUMMARY OF THE INVENTION

An object for the present invention is to provide for a more compact reactor.

This object is achieved by the fact that the separator has a side wall which is common wall with a side wall of the back pass.

The back pass has two common walls: a common wall with the reactor chamber which is preferably a front wall of the back pass and a rear wall of the reactor, and a common wall with the separator, which is a side wall.

The disposition of the separator with the reactor chamber and the back pass is therefore much more compact than in U.S. Pat. No. 4,745,884. Further, as will be described herein-after, a more simple and compact constitution of the connections between the separator and the reactor chamber or the back pass can be achieved. In particular, the means for discharging dedusted gas from the separator to the back pass can comprise one or several openings formed in a side wall of the back pass which is an upper extension of the common wall between the separator and the back pass.

With respect of the prior art, the compact reactor device of the invention has an increased number of common walls between the enclosures of the reactor chamber, the separator and the back pass. The pressures in these enclosures are different from the outside pressure. As a consequence, the walls of these three enclosures are pressure parts that must be strong enough to endure pressure differentials, which involves that these walls are expensive to manufacture and need adapted stiffening means. By increasing the number of common walls, the invention limits the number of such pressure parts and of stiffening means which is advantageous as to costs and ease of manufacture.

The back pass and the means for transferring dedusted gas from the separator into said back pass (e.g. a flue gas plenum) can also have a wall in common that can be a vertical extension of the common wall between the back pass and the separator. The reactor device can also comprise a heat exchanger area, located under the back pass and having a common wall therewith.

The back pass has heat recovery elements with heat exchanging surfaces extending therein. These heat recovery elements can be supported by supports that extend from side to side inside the back pass and that are also used as stiffening means for the walls of the back pass. Such stiffening means are much easier to arrange in the back pass than in the reactor chamber or in the separator because the mixture of gas and particles that circulates in the reactor chamber and in the separator is very aggressive as far as erosion is concerned, whereas the dedusted gas that circulates in the back pass is much less aggressive. With the invention, the common wall between the separator and the back pass, as well as the common wall between the reactor chamber and the back pass, can easily be stiffened by the stiffening means arranged in the back pass, without it being compulsory to foresee specific stiffening means for the concerned wall of the separator.

Advantageously, the device comprises at least one stiffened wall that extends between two supporting walls and that is stiffened by stiffening means comprising a truss beam extending along said stiffened wall and having respective ends that are respectively fastened to one of said supporting walls.

With such stiffening means, only a limited quantity of material is required for stiffening the stiffened wall. They are located along said wall so that they do not significantly disturb the hot flow of gas and/or of gas and particles in the enclosure where they are accommodated. For the reasons explained above, said enclosure is advantageously the back pass.

Although any wall of the reactor device can be stiffened by such stiffening means, these stiffening means are particularly advantageous for stiffening an "internal" wall of the reactor device that is, for example, a common wall between the reactor chamber and the back pass, or a common wall between the back pass and the separator. Generally, the stiffened wall has to bear without buckling a significant pressure gradient between its two faces.

The ends of the truss beam are attached to the supporting walls close to the stiffened wall so that little temperature gradient occurs between the stiffened wall and the attaching places for the ends of the truss beam to the supporting walls, so that the stiffening means are subject to little temperature gradient.

Furthermore, the temperature gradient that applies to the stiffened wall is oriented perpendicularly to said wall and, as a reaction to said gradient, said wall tends to expand or contract in its own direction, that is in the direction of the truss beam. Therefore, the truss beam does not oppose to the expansion or contraction stresses but it prevents that these stresses lead to the stiffened wall being buckled.

Advantageously, the truss beam is attached to the stiffened wall by attaching means allowing a relative sliding between said beam and said wall.

Advantageously, the truss beam is composed of at least a first elongate beam member located against said stiffened wall, a second elongate beam member parallel to said first beam member and spaced therefrom, and a plurality of spacing members, defining spaces between them and connecting said first and second elongate beam members.

In this case, the truss beam has a trellis work structure, which is relatively light despite offering a high mechanical resistance to stresses and which causes very little disturbance to the flow of gas and/or of gas and particles in the enclosure where the truss beam is located. The use of such a trellis work structure avoids that particles or ashes accumulate thereon, and the trellis work structure does not have a significant effect on the heat transfer in the heat exchangers.

Advantageously, the truss beam has a tube structure formed of tubes allowing a circulation of a heat transfer medium therein.

Depending on the location of the truss beam, the heat transfer medium can be water and/or steam. When the stiffened wall is one of the back pass walls, said tube structure can be connected to the heat exchangers situated in the back pass, so that the same heat transfer medium circulates in the tube structure and in the heat exchangers.

When the reactor device has walls provided with heat exchange tubes, it is also possible, whatever the location of the stiffened wall, that said tube structure of the truss beam be connected to said heat exchange tubes so that the same heat transfer medium circulates therein. The truss beam being generally subject to a high temperature, the use of a tube structure with circulation of a heat transfer medium therein is particularly advantageous.

Advantageously, the common walls are planar walls. It is also an advantage that they form between them a substantially right angle.

This enables a easier and more efficient stiffening of the common walls.

Advantageously, the common wall between the back pass and the reactor chamber is the front wall of the back pass, and the separator has a front wall disposed as an extension of said front wall of the back pass.

The fact that the front wall of the separator is aligned with the front wall of the back pass also facilitates the stiffening of these aligned front walls by means of the same rectilinear stiffeners.

All the same, the stiffening of the reactor chamber walls and of the external walls of the separator(s) is facilitated since the loads due to inside pressure are transferred by corners attachment directly through a continuous straight wall.

The presence of common walls enables that expansion joints be avoided. For example, an expansion joint between the reactor chamber, the means for transferring gas to be dedusted to the separator(s) (e.g. an acceleration duct) and the separator can be avoided, as well as can be an expansion joint between the separator(s), the means for transferring dedusted gas to the back pass (e.g. a flue gas plenum) and the back pass. When the reactor device comprises one or several heat exchanger areas located under the back pass and having a common wall therewith, expansion joints can be avoided between the heat exchanger area(s), the reactor chamber and the return duct(s) conveying separated particles into said area(s).

The compact reactor device of the invention can have a reduced content of refractory materials with respect to the prior art; where required, the reactor device walls can have thin refractory layers, instead of thick refractory layers as in the prior art.

Globally, with the above features, a compact and rigid structure is obtained at rather low costs.

In an advantageous embodiment, the separator has a rear wall disposed as an extension of the rear wall of the back pass, opposed to said front wall thereof.

When the front and rear walls of the separator extend as respective extensions of the front and rear walls of the back pass while they are aligned therewith, then the separator and the back pass can present, when considered together, a generally rectangular cross section. Further, the reactor chamber can also present a rectangular cross section. The combination of these two rectangular cross sections achieves a very compact assembly.

Advantageously, the side wall which is common between the separator and the back pass is disposed as an extension of a side wall of the reactor chamber.

In one embodiment, the means for transferring gas to be dedusted from the reactor chamber into the separator comprise an acceleration duct which extends between a wall of the reactor chamber in which an outlet for gas to be dedusted (that is a mixture of gas and particles) is formed and a wall of the separator in which an inlet for gas to be dedusted is formed, said acceleration duct having a cross section which decreases in a direction going from said outlet to said inlet.

In this embodiment, the invention both provides for a very compact structure of the reactor and for a more efficient separation of the particles with respect to the fluidization gas since the mixture of gas and particles enters the separator at rather high speed, which reinforces the efficiency of the centrifugal separation carried out in the separator.

Thus, advantageously, the wall of the reactor chamber in which said outlet is formed is a side wall of said chamber and the separator wall in which said inlet is formed is a front wall of the separator.

In another embodiment, the reactor chamber has a wall portion, that extends as an extension of said common wall between the reactor chamber and the back pass and that is common to a wall portion of the separator, an opening enabling gas to be dedusted to circulate from the chamber to the separator being formed in said common wall portion.

In this other embodiment, a more direct connection between the reactor chamber and the separator is achieved at low costs, since no external acceleration duct is necessary.

Advantageously, the reactor device can be top supported or else bottom supported. The latter possibility results from the compactness of the reactor device and of a possible location of its various components so that its center of gravity be low.

DESCRIPTION OF THE DRAWINGS

The invention will be well understood and its advantages will appear more clearly on reading the following detailed description of embodiments shown by way of non limiting examples. The description is given with reference to the accompanying drawings, in which.

DETAILED DESCRIPTION OF THE PRESENTLY PREFERRED EMBODIMENTS

FIGS. 1 to 6 show a fluidized bed reactor device 10 having an upstanding combustion reactor chamber 12, a centrifugal separator 14 and a back pass 16.

Figure 3:
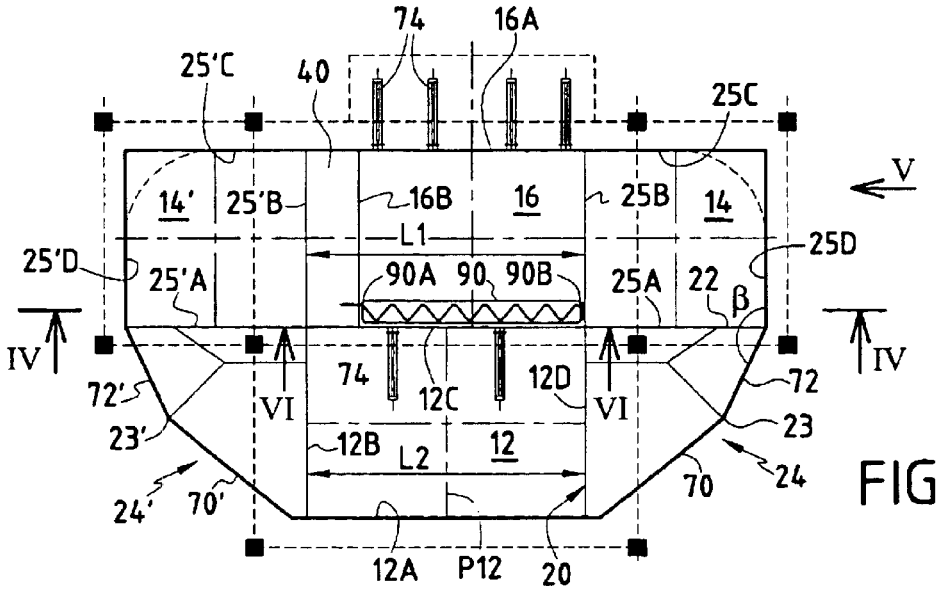
FIG. 3 is a top plan view of this reactor device.

The reactor chamber 12 is delimited horizontally by walls 12A, 12B, 12C and 12D. As seen in FIG. 3, chamber 12 has a generally rectangular horizontal cross section. In the example shown, the side walls 12B and 12D, as well as the rear wall 12C are planar walls that extend vertically.

Front wall 12A has an upper vertical planar portion 13A and a lower planar portion 13B that is inclined with respect to the vertical direction so that the cross section of chamber 12 increases upwardly. Angle $\alpha$ between lower portion 13B and the vertical direction is about 15° to 30° (see FIG. 5).

Chamber 12 has several inlets 18 for solid material such as fuel and sorbent particles, located in the lower third part of lower wall portion 13B. Further, as shown by arrow G1 in FIG. 1, the bottom of chamber 12 has means for introducing a primary fluidizing gas or fluidizing air into said chamber, so as to maintain a fluidized bed of solid particles in this chamber.

By way of example, this primary fluidizing gas or air can be introduced from an air plenum located below chamber 12 and separated therefrom by a distribution plate having nozzles or the like.

Figure 1:
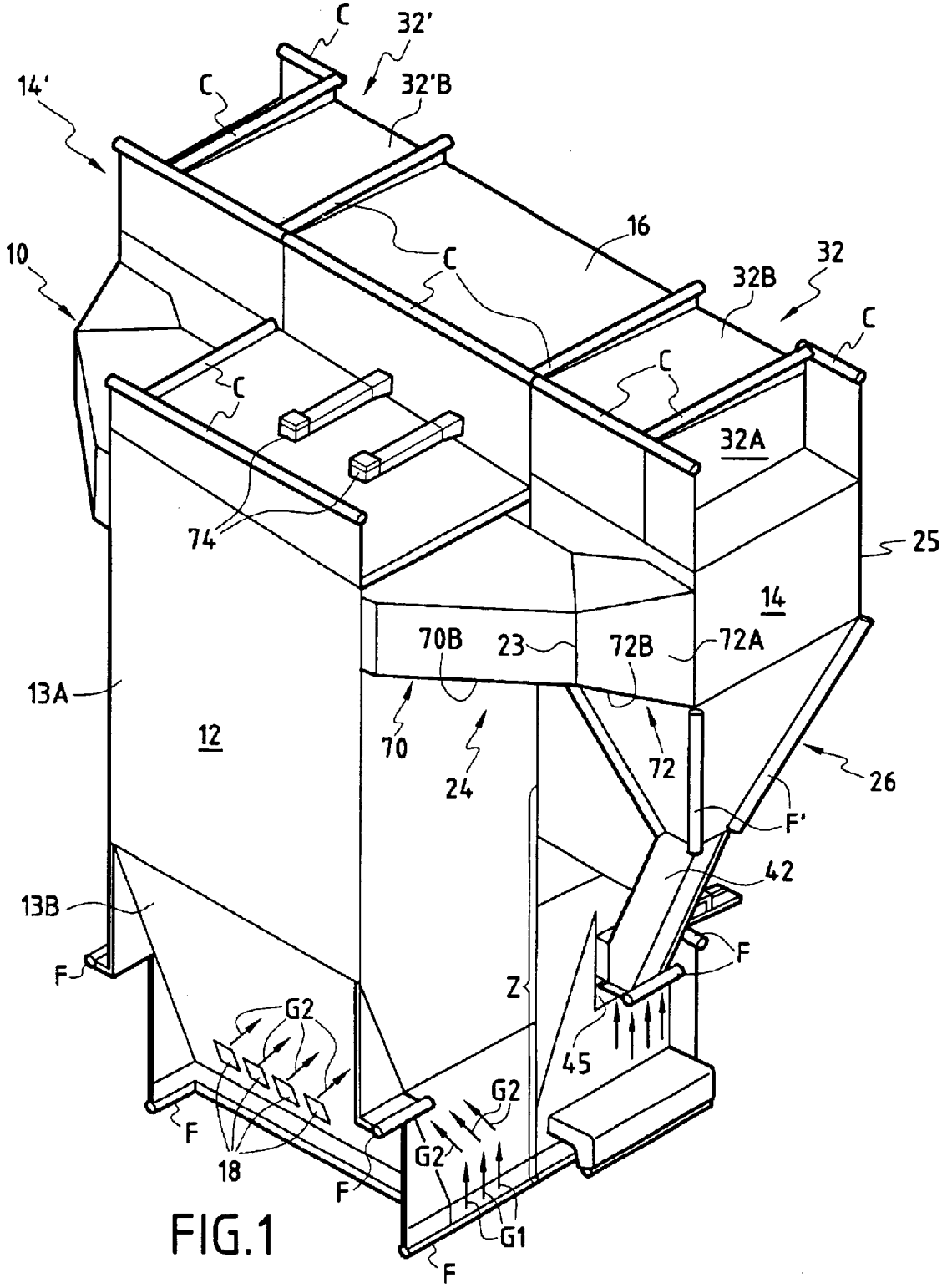
FIG. 1 is a perspective view of a fluidized bed reactor device according to a first embodiment of the invention, taken from the front.

As shown by arrows G2 in FIG. 1, secondary fluidization gas or air can be introduced into chamber 12, above the inlets 18 but still in the lower part of the chamber. In the example shown, the secondary fluidization gas or air is introduced through the front wall and/or through the side walls of the chamber. In some cases, for example when the volume of chamber 12 is important, the lower portion of this chamber can be divided in two leg-like portions, having facing wall portions through which secondary fluidization gas or air can be introduced into the chamber.

The fluidized bed generally flows upwardly in chamber 12 so that a flow of gas carrying particles escapes said chamber through an opening 20 located in the upper portion thereof. More precisely, opening 20 is disposed in a top portion of side wall 12D of the chamber.

This opening forms an outlet for gas to be dedusted which is connected to an inlet for gas to be dedusted 22 formed in wall 25A of the separator 14, via an acceleration duct 24 in which the mixture of gas and particles is accelerated.

The upper portion of separator 14 is delimited horizontally by walls 25A, 25B, 25C, and 25D. These walls are preferably planar walls. They extend vertically so that this upper portion of separator 14 has a substantially constant horizontal cross section, preferably a rectangular cross section or, more preferably, a square cross section.

The lower portion 26 of the separator has a cross section that decreases downwardly and thus forms a funnel-like or a hopper-like structure, the bottom part of which having an outlet 28 for solids.

In the separator, a vortex flow takes place, so that particles initially carried by the gas entering the separator are separated from said gas by centrifugal separation.

The vortex flows downwardly along the separator walls and then upwardly in a central region of the separator.

The roof 25E of the separator has an opening 30 for the dedusted gas flowing upwardly to escape the separator. A vortex finder 30A is installed around this opening so as to guide the flow of gas. For example, the vortex finder can be a cylindrical skirt or a tapered skirt with an upwardly increasing cross section. It can be a concentric conical skirt or an eccentric conical skirt. The axis of this vortex finder can be vertically aligned with outlet 28 for the separated solids or can be somewhat offset towards side wall 25B and/or towards front wall 25A of the separator with respect to said outlet.

Figure 14:
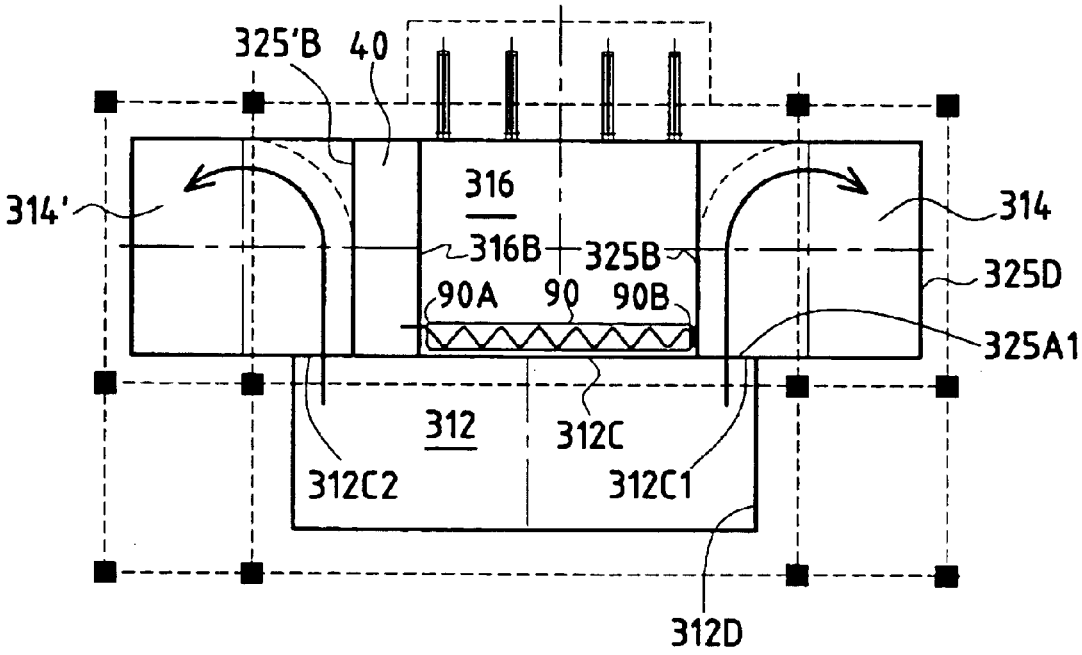
FIG. 14 is a top view of another embodiment.

In the embodiment of FIG. 14, the offset can be towards external side wall 325D and/or towards front wall 325A.

This opening opens in an flue gas plenum 32, that is formed above the separator and that communicates with the back pass 16 in order to achieve the transfer of dedusted gas from the separator to the back pass which constitutes a vertical convection section provided with heat recovery surfaces 36 for recovering heat of the dedusted hot gas which flows downwardly in the back pass.

The flue gas escapes the back pass through an outlet 38 formed in a lower portion thereof, in its rear wall 16A disposed opposite to the reactor chamber. The dedusted flue gas or part of it can be re-circulated in the reactor device, for example while being re-introduced into the reactor chamber or into the bubbling beds described herein-below, so as to serve as fluidization gas.

Figure 4:
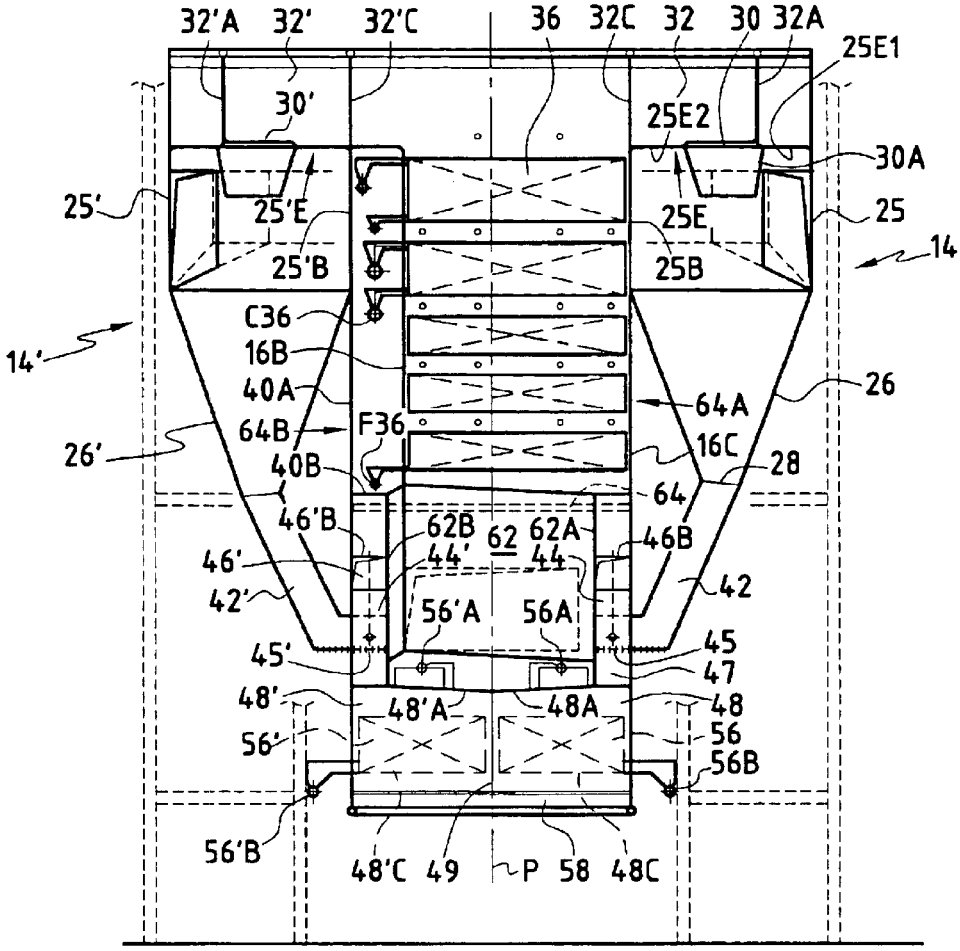
FIG. 4 is a section along line IV—IV of FIG. 3.

As best seen in the top view of FIG. 3, wall 12C of the reactor chamber is common to said chamber and to the back pass, and wall 25B of the separator is common to said separator and to the back pass. This wall 25B is an upward extension of side wall 16C of the back pass. Indeed, as seen in FIG. 4, only the upper part of the back pass in the first embodiment has a common wall with separator 14.

Considering that the reactor chamber is situated in a front part of the reactor device, whereas the back pass is located in a rear part thereof, common wall 12C is a rear wall of the reactor chamber and a front wall of the back pass, whereas common wall 25B is a side wall of the separator and a side wall of the back pass. In the example shown, common walls 12C and 25B are perpendicular.

Figure 2:
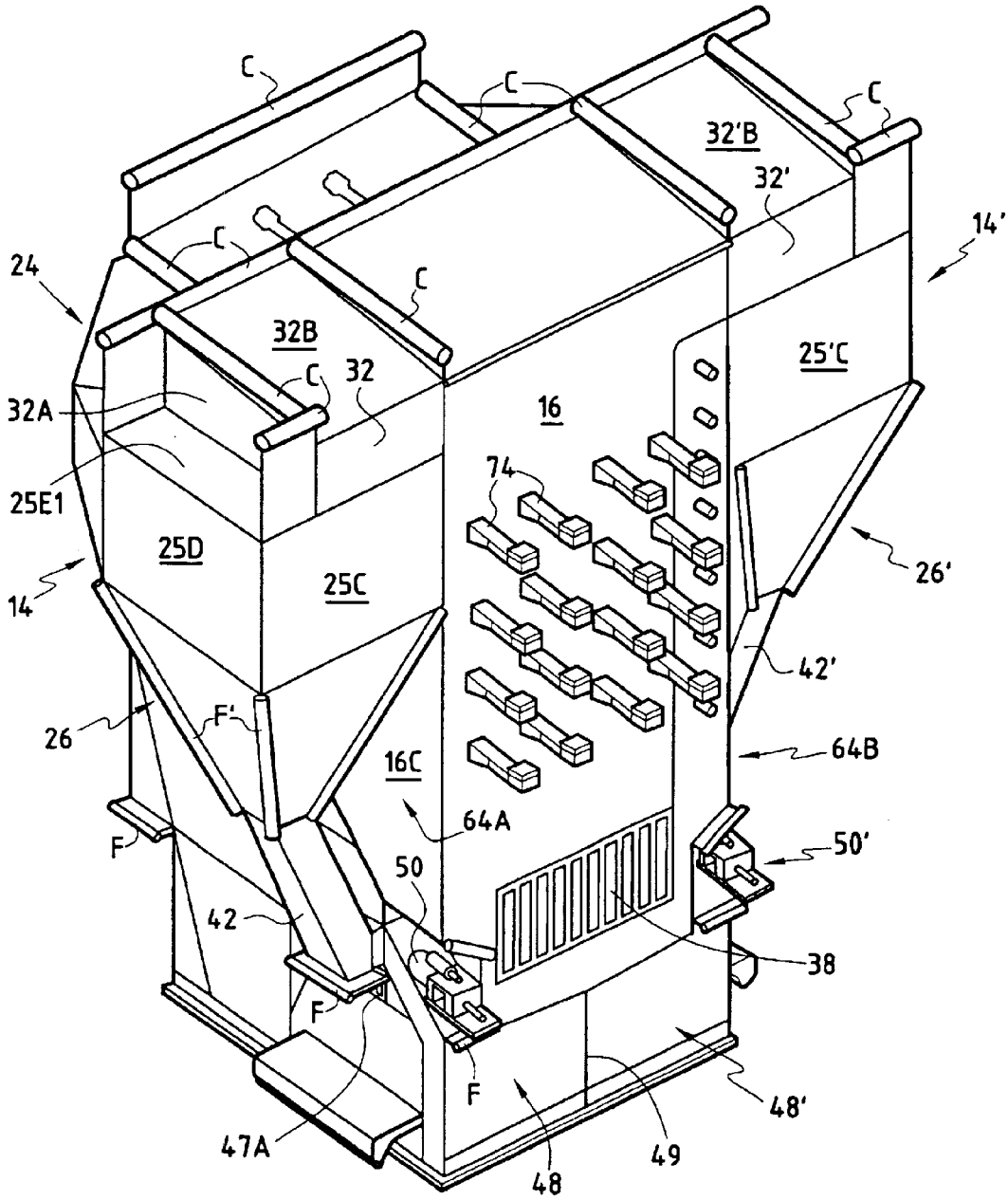
FIG. 2 is a perspective view of the same device, taken from the rear.

As best seen in FIG. 2, the separator has four outer walls 25A, 25B, 25C and 25D that define a generally rectangular shape or, preferably, a square shape, in horizontal cross section.

In the example shown, the reactor device has another separator 14', similar to separator 14. Separator 14' is disposed on the opposite side of the back pass, with respect to the separator 14 and it has an upper portion 25' with four planar walls, 25'A, 25'B, 25'C and 25'D.

Side wall 25'B of this upper portion is disposed next to the back pass. However, a header box 40 is located between side wall 25'B of separator 14' and the side wall 16B of the back pass that is disposed opposite to common wall 25B. This header box accommodates feeding pipes F36 and collecting pipes C36 for the tubes forming the heat recovery surfaces in the back pass 16. The lower portion 26' of separator 14' is connected to a return duct 42' analogous to return duct 42.

The header box 40 is inserted between separator 14' and the back pass so that the reactor device as an overall compact structure despite the fact that separator 14' has no common side wall with the back pass.

Instead of header box 40, it could be advantageous to locate some headers in the bottom part of the back pass (where the flue gas is at relatively low temperatures of e.g. 450° C.) and the other headers above the back pass.

In the embodiment of FIGS. 1 to 4, it needs to be noted that the width L1 of the assembly constituted by the back pass and the header box, as measured from side wall 25'B of separator 14' to side wall 25B of separator 14, is equal to the width L2 of the reactor chamber 12 as measured from side wall 12B to side wall 12D of the latter.

Side walls 12D and 25B are aligned and, since L1 and L2 are equal, side walls 12B ad 25'B are also aligned. Therefore, despite the implementation of header box 40 between the back pass and separator 14', the transferring means for conveying gas to be dedusted from the reactor chamber to, respectively, separator 14 and separator 14', can be implemented in a symmetrical manner.

As a matter of fact, an opening 20' is formed in side wall 12B of the chamber in a similar manner as opening 20 in side wall 12D, and forms a second outlet for gas to be dedusted, which is connected, via an acceleration duct 24', to an inlet for gas to be dedusted formed in wall 25'A of separator 14'.

The lower portion 26' of separator 14' is analogous to that of separator 14 while being disposed in a symmetrical manner with respect thereto.

The gas dedusted in separator 14' escapes the latter and enters in the back pass via a central opening 30' formed in the top wall 25'E of separator 14' and flue gas plenum 32', that is located above this top wall and that communicates with the back pass as flue gas plenum 32 does.

The front wall 25A of separator 14 is aligned with the front wall of the back pass 16, formed by common wall 12C. In other words, this front wall forms an extension of this wall 12C, aligned with this wall. Similarly, front wall 25'A of separator 14 forms an extension of wall 12C.

In the illustrated example, the rear wall of the back pass is also aligned with the rear walls 25C, 25'C, of the separators 14, 14'. Consequently, the buckstays or stiffeners for these two walls are easy to install.

The particles that are separated from the gas in separators 14 and 14' are re-circulated by means of a return duct 42 that is connected to the outlet 28 for solids at the bottom of the lower portion 26 of separator 14.

In the example shown in FIGS. 1 to 6, there are two complementary paths for re-introducing the particles from this return duct into the reactor chamber.

The first re-injection path is a direct one. Indeed, the bottom part of return duct 42 has a particle seal, for example a seal pot 44 acting as a siphon, the outlet of which is connected to a re-introduction duct 46 by means of which the particles passing the seal pot are re-introduced in the reactor chamber 12, in the vicinity of the lower part thereof.

Figure 6:
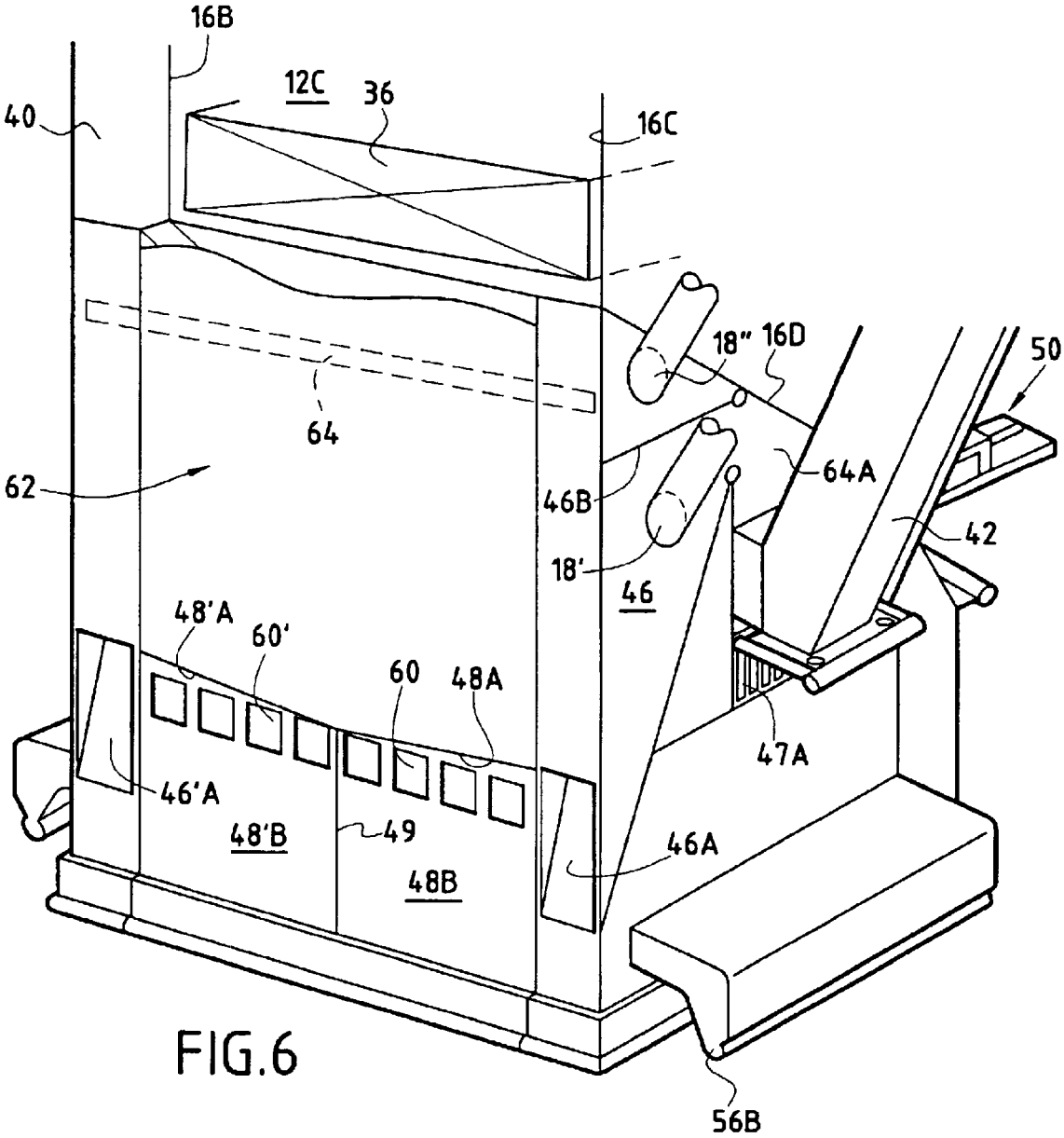
FIG. 6 is a section of part Z of the device shown in FIG. 1, taken along line VI—VI of FIG. 3, that is in the common wall between the reactor chamber and the back pass.

In addition to the above mentioned inlets 18, or as an alternative thereto, some inlets for fresh particles (including fuel sorbent particles) can be formed so that these fresh particles be introduced into chamber 12 via the re-introduction duct. For example, as shown in FIG. 6, one or several fresh particles inlets can comprise inlets 18' formed in the outer side wall of duct 46 so as to directly communicate with this duct 46 or inlets 18" located just above duct 46, so as to communicate with this duct through roof 46B thereof (in the latter case, this roof has adapted openings).

Fluidization gas or air is introduced into the seal pot, in the lower part thereof, via gas inlets 45 formed in the bottom wall of the seal pot, said bottom wall separating the valve from an air inlet box 47 located under this valve. FIGS. 2 and 6 show the inlet 47A for introducing air into said air inlet box.

In the second re-injection path, the particles enter a heat exchanger area 48 located under the back pass 16 and, from this heat exchanger area, they are re-introduced into the reactor chamber, in a lower portion thereof.

To this effect, the bottom part of return duct 42 (or the seal pot 44) has a wall portion 42A (or 44A) provided with one or several openings that can be opened or closed by means of a solids flows control valve 50 controlled by any suitable control means.

For example, the solids flow control valve 50 can be controlled pneumatically or hydraulically. When this valve is opened, return duct 42 is connected to a solids transfer duct 52 via the above mentioned openings formed in wall portion 42A or 44A that separates the return and solids transfer ducts.

Figure 5:
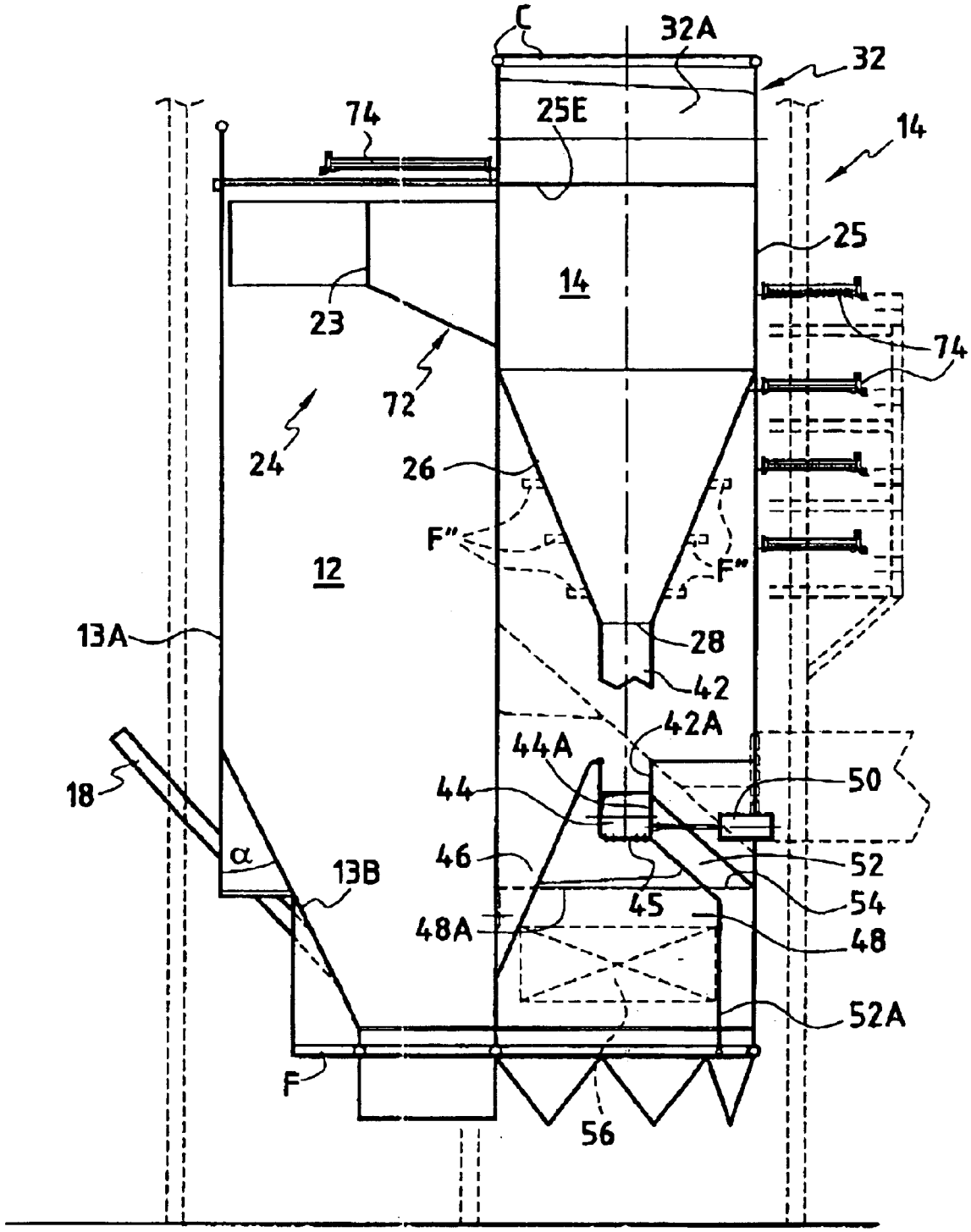
FIG. 5 is a side view according to arrow V in FIG. 3.

Duct 52 is connected to heat exchanger area 48 by an opening 54 formed in the roof 48A of said area (FIG. 5). The front wall 52A of duct 52 extends in area 48 so as to be connected to the bottom of the reactor device, but only on a small portion of the width of said area. Alternatively, duct 52 can extend in a portion of the heat exchanger area 48.

Heat exchanger area 48 is a chamber, in which heat exchanging surfaces 56 are accommodated and that forms a bubbling bed into which a bubbling gas is introduced via a gas or air inlet box 58 located under heat exchanger 48.

In this bubbling bed, depending on the gas speed and on the extent of opening of valve 50, the density of particles can be higher than in the fluidized bed created in the reactor chamber 12.

As seen in FIG. 6, the heat exchanger 48 has one or several particles outlets 60 for the particles in the bubbling bed to be re-introduced into the reactor chamber.

Preferably, these outlets are formed in a common wall 48B between heat exchanger 48 and chamber 12. This common wall is aligned with common wall 12C between chamber 12 and the back pass 16 and forms a lower portion of the rear wall of chamber 12. Preferably, common wall 48B has heat exchange tubes extending therein, and the outlets 60 are formed by bending said tubes. A variant embodiment has a sloped common wall 48B allowing chamber 12 to have a symmetrical bottom part, with a reduced height.

The outlets 60 are located just under roof 48A of heat exchanger 48 and above the level of particles inlet 18 in chamber 12. A possible embodiment for wall 48B is a double wall structure with or without intermediate stiffening means.

FIG. 6 also shows the particles outlet 46A of direct re-introduction duct 46 enabling the separated particles in the separator 14 to be directly re-introduced into chamber 12.

Outlet 46A is formed in the rear wall of chamber 12, at substantially the same horizontal level as outlets 60 (as far as the top part of outlet 46A is concerned).

The same possibility of using a direct re-injection path of separated particles and/or an indirect re-injection path via a heat exchanger is offered for separator 14'.

In fact, the lower part of return duct 42' has a seal pot 44' with gas inlets 45' and this seal pot is connected to a re-introduction duct of which the outlet 46'A in chamber 12 is shown in FIG. 6. A solids flow control valve 50' analogous to valve 50 enables particles to be circulated from seal pot 44' into a heat exchanger area 48' having heat exchanging surfaces 56' and similar to heat exchanger area 48.

Heat exchanger area 48' has particles outlets 60' similar to outlets 60 and formed likewise via wall 48'B constituting a common wall with chamber 12, in a lower portion of the rear wall thereof.

The two separators 14 and 14' are disposed symmetrically on either side of a central front-rear vertical plane of symmetry P. Likewise, the return ducts 42 and 42', the re-introduction ducts 46 and 46' and the heat exchangers 48 and 48' are respectively symmetrical with respect to plane P, heat exchangers 48 and 48' being separated from one another by a partition wall 49 extending in plane P, from roofs 48A, 48'A to the bottoms 48C, 48'C of the heat exchanger areas.

As shown in FIG. 6, the outlets 60, 60', 46A and 46'A extend over substantially the entire width of the combustion chamber 12 as measured from side to side thereof, so that particles are re-introduced over substantially the whole width of the chamber, which enables these particles to better mix in the carrying gas of the fluidized bed. Should only one separator be present, then it would still be possible to implement outlets 60 and 46A over substantially the whole width of the reactor chamber. FIG. 6 shows that outlet(s) 46A (and 46'A) for direct re-introduction of particles is (are) situated closer to an outer side of the reactor chamber with respect to the outlet(s) 60 (and 60') that are located in an inner part of this chamber. With the two separators and their respective return and with the two heat exchanger areas of the invention as shown, the outlets 60 and 60' are located between the outlets 46A and 46'A.

As best seen in FIG. 6, the back pass 16 has a bottom wall 16D inclined downwardly from the front to the rear. There remains a space 62 between this bottom wall 16D and the roofs 48A, 48'A of heat exchangers 48, 48'. This space 62 is delimited horizontally by side walls 62A, 62B (see FIG. 4). It is isolated from gas and from particles and has a front wall formed by a medium portion of rear wall 12C of the combustion chamber. Space 62 is advantageously used for locating external elements of the reactor device.

For example, as seen in FIG. 4, the headers 56A, 56'A for the tubes forming the heat exchanging surfaces 56, 56' are located in space 62 whereas the inlets 56B, 56'B for said tubes are respectively disposed on the outer sides of the heat exchangers 48 and 48', respectively below separators 14 and 14'.

Space 62 is also advantageously used for locating one or several stiffening bars 64 that extend from side to side though the reactor device. More precisely, the assembly of the back pass 16 and of the heat exchanger (s) 48 (and 48') extends within an upright parallelepiped enclosure having side walls 64A, 64B. Wall 16C of the back pass with common wall 25B that constitutes an upper portion thereof, is part of side wall 64A, whereas wall 25'B of separator 14' forms the upper part of side wall 64B, a medium part of which being formed by outer side wall 40A of header box 40 (see FIG. 4).

The stiffening bars 64 extend from side wall 64A to side wall 64B.

Most advantageously, the seal pot(s) 44 (and 44'), the re-introduction duct(s) 46 (and 46') and the solids transfer duct(s) 52 (and 52') are also enclosed in the said upright parallelepiped enclosure.

In fact, seal pot 44 (with air inlet box 47), duct 46 and solids transfer duct 52 (and also heat exchanger 48) are all located under the back pass 16 and contained within a space delimited by the downward vertical projection of the walls 16A, 16B, 16C of the back pass and by rear wall 12C of the combustion chamber, an upper part of which forms the front wall of the back pass.

Duct 46 and, preferably, also seal pot 44 and solids transfer duct 52 are contained between outer side wall 64A and inner side wall 62A. Further, duct 46 is separated from space 42 by its top wall 46B located under wall 16D.

Likewise, duct 46' and, preferably, seal pot 44' and solids transfer duct 52' are contained between outer sidewall 64B and inner sidewall 62B. Duct 46' has also its top wall 46'B extending under wall 16D.

Therefore, as seen in FIG. 4, stiffening bars 64 can extend from wall 64A to wall 64B without interfering with ducts 46 and 46'.

The different walls of the reactor device comprise heat exchange tubes in which a heat transfer medium can circulate. Depending on the pressure and temperature conditions in the tubes, this heat transfer medium can be water, water steam or a mixture thereof.

Thus, walls 12A, 12B, 12C and 12D of the combustion chamber 12 form tube-fin-tube structures in the tubes of which the heat transfer medium circulates. This is also the case of walls 16A, 16B, 16C and 16D of the back pass 16 and of the walls of heat exchangers areas 48, 48'.

The tubes of the vertical walls of chamber 12 and of back pass 16 can be bent so as to form the roofs thereof. For a better circulation of the heat transfer medium the wall having tubes are orientated so that the flows circulates upwardly. Therefore, the roofs of chamber 12 and of back pass 16 are not horizontal, but they are slightly inclined upwardly (e.g. of 5°). This inclination can be avoided, if dry steam circulates in the walls and roofs of the reactor chamber and of the back pass. On their inner sides, some areas of the walls of the combustion chamber are lined with a thin refractory layer, where adapted.

The walls of the separators also comprise tubes for circulation of a heat transfer medium, preferably dry steam. This also applies to the lower, hopper shaped portions of the separators and to the flue gas outlet plenum. It can also apply to their return ducts but, alternatively, it is possible that the return ducts not be cooled by a heat transfer medium and, then, be lined with refractory material.

Figure 7:
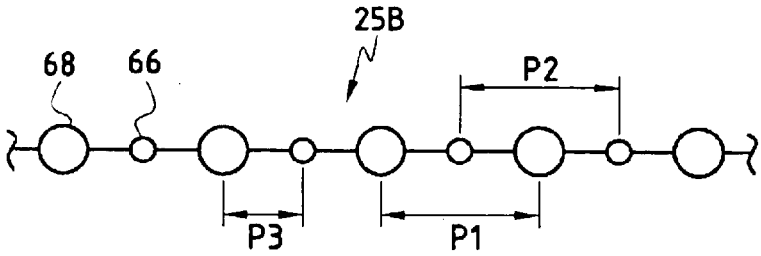
FIG. 7 is a horizontal section in the common wall between the back pass and the separator.

As shown in the horizontal section of FIG. 7, the common wall 25B between the back pass and the separator 14 comprises tubes 66 that are connected to a series of heat exchange tubes in other walls of the separator (e.g. for circulating a first fluid transfer medium such as dry steam) and tubes 68 that are connected to a series of heat exchange tubes in other walls of the back pass (e.g. for circulating a second fluid transfer medium such as cooling emulsion). The tubes of these two series are alternated in common wall 25D, a tube 66 being disposed between two successive tubes 68.

In the other walls of the back pass, in "normal" sections thereof, where the tubes are not bent (e.g. for forming openings), the tubes 68 are separated by a pitch P1 and in the "normal" sections of the walls of the separator, the tubes 66 are separated by a pitch P2. In the common wall 25B, it is advantageous that the tubes are not bent, so that pitches P1 and P2 remain unchanged. However, since tubes 66 and 68 are alternated, pitch P3 between two adjacent tubes in common wall 25B (a tube 68 and a tube 66) is half of the pitches P1 and P2.

In the medium and lower portions of wall 16C of the back pass that extend below the common wall 25B, there only remain tubes 68, since tubes 66 of the common wall come from the tubing of lower portion 26 of the separator.

Wall 16B of the back pass, that separates the back pass from the header box, comprises tubes such as tubes 68 that are bent so as to form the bottom wall of the header box and the lower vertical part of side wall 64B (which lower part is the outer side wall of duct 46' and of heat exchanger 48'). The inner walls 62A and 62B of space 62 can incorporate heat transfer tubes coming from the roofs 48A and 48'A of the heat exchanger areas. In a variant embodiment, these tubes coming from walls 62A and 62B can also form the bottom of the header box, the wall 16B and the bottom 16D of the back pass.

An acceleration duct 24 between the reactor chamber and the separator significantly improves the separator efficiency and allows to increase the residence time in the reactor loop of the fuel to be burnt and of the sorbent introduced for sulphur capture. Indeed, an increased residence time decreases the average size of the particles to be separated, which is beneficial for heat transfer.

Acceleration duct 24 extends from outlet 20 formed in the side wall 12D of chamber 12, to inlet 22 formed in the front wall 25A of separator 14, in the upper portion thereof.

As best seen in FIGS. 1 and 3, duct 24 has a first part 70 connected to wall 12D and a second part 72 connected to wall 25A. These first and second parts present substantially planar walls and they are connected together at a knee 23 of duct 24.

Generally, the acceleration duct has a cross section, as measured perpendicularly to the flow of particles carrying gas within this duct, that decreases in the direction going from outlet 20 to inlet 22.

As a matter of fact, the first part 70 of the acceleration duct 24 has a cross section that decreases towards the knee 23, whereas the second part 72 has a cross section that remains substantially unchanged from knee 23 to inlet 22.

Advantageously, the acceleration duct 24 is connected to the outer sidewall 25D of separator 14 in a substantially tangential manner, so that installation of the centrifugal vortex inside the separator occurs without significant disturbance. In fact, angle β between wall 25D and the outer sidewall 72A of duct 24 that is connected to wall 25D is advantageously comprised between 120° and 175°. The acceleration duct can also have three parts connected by two knees so that the last part, that is connected to the separator, can be tangential to the outer side wall 25D (angle β of 180°), while the knees form obtuse angles.

Also, the separation of solids in the vortex is facilitated if the flow of gas and particles enters the separator with a downwardly directed component. To this effect, lower wall 72B of duct 24 (of the second part 72 thereof) that is connected to the separator is advantageously inclined downwardly in a direction going towards the front wall 25A of the separator. The inclination with respect to the horizontal direction, in a plane perpendicular to the separator front wall can be up to 40°. The lower wall of the acceleration duct is advantageously also inclined downwardly towards the outer side wall of the duct (the extrados wall) in a plane parallel to the separator front wall, so that particles circulating in this duct that are collected be this extrados wall be suitably guided into the separator chamber. This inclination towards the extrados wall can be up to 40° with respect to a horizontal plane.

The acceleration duct suitably has its walls provided with tubes for circulation of heat transfer medium.

In such case a first portion of the acceleration duct (possibly the whole first part 70 thereof) comprises tubes that are connected, as far as the circulation of the fluid transfer medium is concerned, to the tubes of the walls of combustion chamber 12, whereas a second portion of duct 24 (possibly the whole second part 72 thereof) comprises tubes that are connected, as far as the circulation of the heat transfer is concerned, to the tubes of the separator walls.

More precisely, tubes of the walls of the combustion chamber 12 are bent so as to extend into the walls of said first portion of duct 24, whereas tubes of the separator walls are bent so as to extend into the walls of the second portion of the acceleration duct 24. For example, the tubes of the lower wall of the first portion come from side wall 12D of the reactor chamber, the two halves of these tubes are bent so as to respectively form the two side walls of the said first portion, and they are further bent and gathered so as to form the upper face of this first portion and then to join side wall 12D above the acceleration duct. The conformation of the second portion of the acceleration duct is analogous, with tubes coming from the front face of the separator.

Bending these tubes also defines the respective openings forming respectively outlet 20 in wall 12D and inlet 22 in wall 25A.

This enables to form the walls of duct 24 with heat exchange tubes without the necessity of providing any specific feeding means or collecting means for the heat transfer medium that circulates in these tubes.

The lower wall 70B of first part 70 of duct 24 is slightly inclined upwardly in the direction going away from wall 12D for an upward circulation of the emulsion forming the heat transfer medium in the tubes of said first part, until knee 23.

The cross section of duct 24 in the vicinity of inlet 22 is about half the cross section of this duct in the vicinity of outlet 20, these cross sections being measured perpendicularly to the flow of gas and particles in the acceleration duct 24.

Likewise, the acceleration duct 24' that connects chamber 12 to separator 14' is formed of two parts, respectively 70' and 72' connected at knee 23'. Acceleration ducts 24 and 24' are similar and symmetrical with respect to a medium plane of symmetry P12, that is a medium front-rear plane of chamber 12. In particular, the first and second parts 70', 72' of duct 24' are equipped with tubes respectively connected to the tubes of the walls of chamber 12 and to the tubes of the walls of separator 14'.

The acceleration duct(s) as well as (as described hereinbelow) the return duct(s) advantageously have their walls provided with tubes for circulation of a heat transfer medium. Alternatively, it is also possible that the acceleration duct(s) and/or the return duct(s) be lined with a refractory material.

The walls of separator 14 comprise tubes as indicated below.

The roof 25E of the separator 14 has an outer portion 25E1, that is remote from common wall 25B and that is formed of bent tubes coming from outer side wall 25D, these tubes being bent in the vicinity of opening 30 so as to form the upright side wall 32A of flue gas plenum 32.

The other part 25E2 of roof 25E is also equipped with heat exchange tubes. In this case, these tubes come from tubes 66 of common wall 25B that are bent so as to extend substantially horizontally. These tubes are further bent while remaining in a substantially horizontal plane, so as to form opening 30, and are then bent once more so as to extend vertically and to pertain to outer side wall 32A of the flue gas plenum.

Some of the tubes that are bent around opening 30 can extend vertically in the vicinity of this opening so as to support the roof 25E and the vortex finder 30A ; these tubes go through roof 32B of the flue gas plenum so as to be connected to an outer supporting structure. In addition, some tubes 68 coming from common wall 25B can be routed in roof 25E2, then extended vertically in areas where supports are required for roof 25E2; these tubes can go through roof 32B of the flue gas plenum so as to be connected to an outer supporting structure. Roof 25E2 can have a single wall structure, common to separator 14 and plenum 32, or a double wall structure, with or without intermediate stiffening means.

The outer side wall 32A has tubes coming from both side walls 25B and 25D of separator 14 so that the pitch between two adjacent tubes of this wall is about half the pitch in walls 25B and 25D. Alternatively, the tubes coming from both side walls 25B and 25D can be welded by connection fittings such a T fittings at the bottom of wall 32A so that the original pitch between the tubes be preserved in wall 32A.

The front and rear walls of flue gas plenum 32 extend as vertical extensions of, respectively, front and rear walls 25A and 25C of separator 14 and are therefore equipped with the heat exchange tubes of these respective walls.

The roof 32B of flue gas plenum 32 also comprises heat exchange tubes formed by bent tubes coming from the front and/or the rear walls of this flue gas plenum. An alternative could comprise bent tubes coming from side wall 32A.

In the example shown, the tubes of roof 32B come from the tubes of rear wall 25C of the separator, these tubes being bent so as to extend substantially horizontally with a slight upward inclination towards the front wall.

The flue gas plenum 32 has its inner side wall 32C that forms a common wall between the flue gas plenum and the back pass. In fact, this common wall 32C extends as an upper vertical extension of common wall 25B between the separator and the back pass and it is formed by the upper end of side wall 64A. Therefore, the said common wall 32C is equipped with those heat exchange tubes that are disposed in wall 64A.

Common wall 32C between the flue gas plenum 32 and the back pass has one or several openings formed therein for the dedusted gas flowing from the vortex in separator 14 into the flue gas plenum, to enter the back pass.

This or these openings are preferably formed by bent portions of the tubes that are disposed in common wall 32C between the flue gas plenum and the back pass.

Alternatively or complementarily, the walls of the flue gas plenum or parts of these walls can have a refractory lining.

The same applies to the flue gas plenum 32' located above separator 14' as to the tube-fin-tube structure of its walls, including its bottom wall 25'E, its roof 32'B and its side wall 32'C which is common to said flue gas plenum and to the back pass. In particular, the bottom wall 25'E and the outer side wall 32'A are have the tubes coming from the separator's side walls 25'B and 25'D and the roof 32'B has tubes coming from the rear wall 25'C of separator 14', whereas common side wall 32'C has its tubes coming from side wall 16B of the back pass. The opening 30' in bottom wall 25'E and the openings in wall 32'C for communication between the flue gas plenum and the back pass are formed by bent portions of the respective tubes of said walls.

The reactor device has headers F and C for feeding and collecting the heat transfer medium circulating in the heat exchange tubes. In general, but not always, the headers F that are located at the bottom of the walls of the reactor device are feeding headers, whereas the headers C that are located at the upper ends of the wall are collecting headers.

Due to its hopper like form, the lower portion of separator 14 has some intermediate feeding or collecting headers F' disposed at the angles between its walls according to their increasing surfaces in the upwards direction. The same applies to separator 14'. These intermediate feeding or collecting headers can extend along or within the inclined edges of the lower portion of the separators, as shown, or they can extend horizontally as suggested at F" in FIG. 5.

Although dedusted in the separators 14 and 14', the gas that flows in the back pass carries a small amount of particles in the form of flying ashes. It is therefore necessary to regularly clean up the heat recovery surfaces 36 inside the back pass. This is why soot blowers 74 that can be moved to and fro in the back pass are shown in the drawings.

Figure 8:
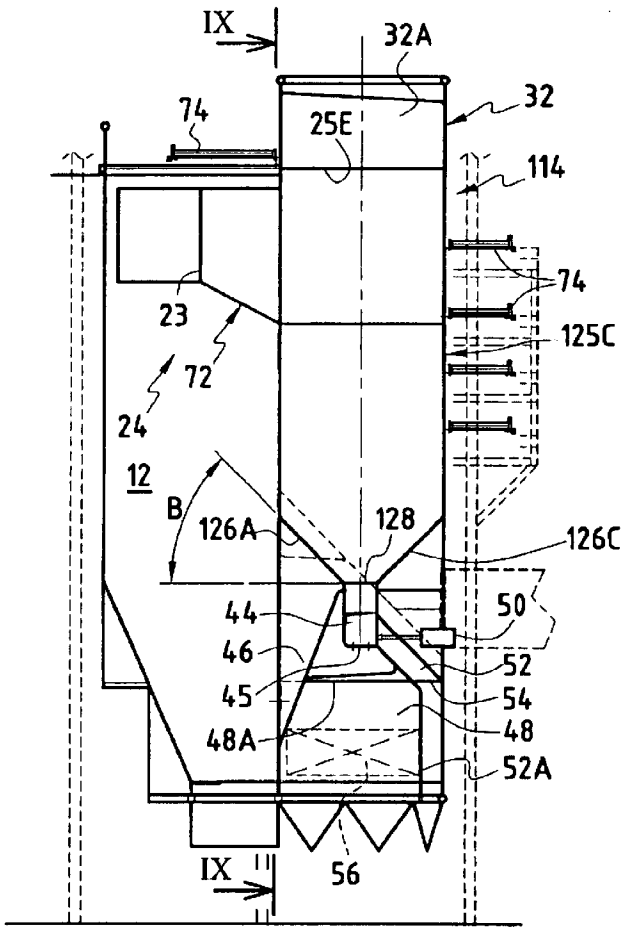
FIG. 8 is a side view analogous to that of 5, showing a variant embodiment.
Figure 9:
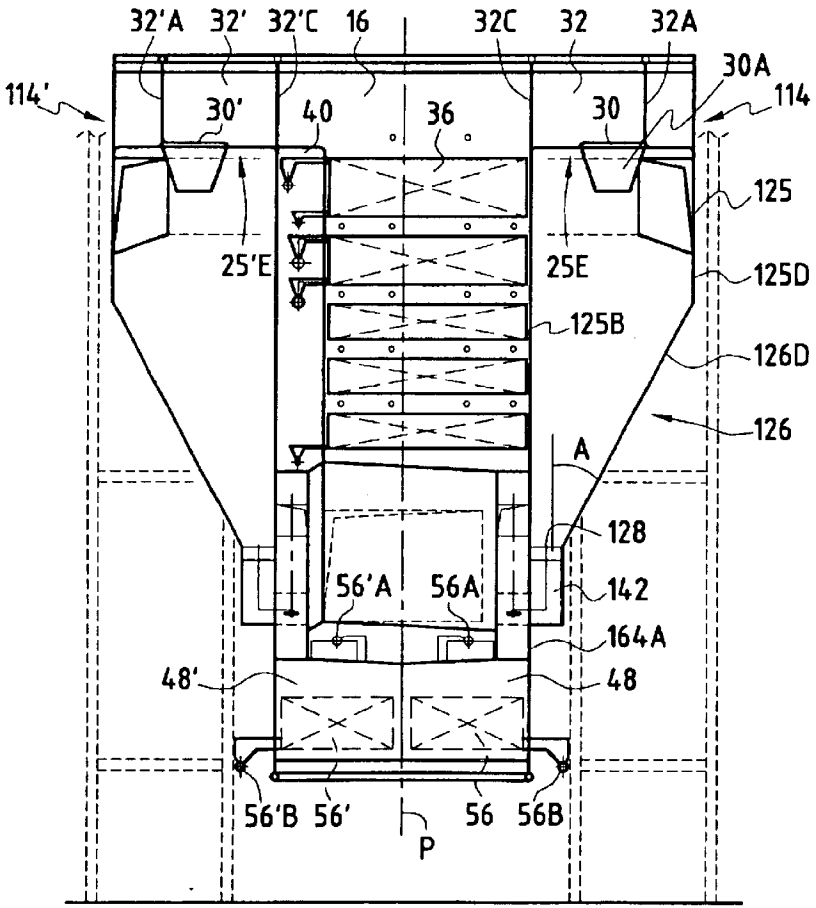
FIG. 9 is a vertical section along line IX—IX of FIG. 8.

FIGS. 8 and 9, that show a variant embodiment of the reactor device according to the invention are described hereinafter.

This variant embodiment differs from the one of FIGS. 1 to 6 in the conformation of the separators.

Separator 114 has an upper portion 125, analogous to upper portion 25 of separator 14 and likewise connected to the combustion chamber 12 by acceleration duct 24 and to back pass 16 via an opening 30 in its roof 25E that opens in flue gas plenum 32.

Separator 114 also has a lower portion 126 of which the horizontal cross section decreases downwards.

Wall 125B of the separator 114, which forms an inner side wall thereof, is a common wall between the separator and the back pass. Unlike the variant of FIGS. 1 to 6, this common wall extends not only in the upper portion of the separator, but also in the lower portion thereof.

The outer side wall of the separator has an upper portion 125D that is parallel to the inner side wall 125B and a lower portion 126D that is inclined towards the inner side wall in the downward direction, so that the cross section of lower portion 126 decreases. The upper portion 125 of separator 114 has a substantially square cross section, whereas the lower portion 126 has a substantially rectangular cross section, the length of which is equal to the length of one side of the square cross section of the upper portion.

As a matter of fact, the separator has front and rear walls 125A, 125C that extend vertically so as to form the front and rear faces of both the upper and the lower portions of the separator.

The inclination A of wall 126D with respect to the vertical direction is advantageously comprised between 25° and 45°, preferably 35°.

The lower part 126 of the separator has front and rear bottom walls 126A, 126C, respectively connected to the front and rear walls 125A, 125C and inclined downwardly from these respective walls towards outlet 128 for solids separated in the separator.

The inclination B of bottom walls 126A, 126C with respect to the horizontal direction is advantageously comprised between 45° and 70° (e.g. about 50°).

Therefore, the converging part of separator 125 formed by the lower portion thereof is essentially obtained by the inclined outer side wall 126D of the separator with the other three outer walls thereof remaining substantially vertical over substantially the whole height of the separator. Only at a small distance above outlet 128 are the lower ends of the vertical front and rear walls 126A, 126C are connected to this outlet 128 via slightly inclined bottom walls. The inner side wall 125B of separator 114 remains vertical over its whole length.

This enables the overall structure of the separator to be simpler than in the embodiment of FIGS. 1 to 6 and in particular, it facilitates the tube or tube-fin-tube constitution of the separator walls since the outer side wall 126D, 125D of the separator can have the same number of tubes disposed therein from its lower end up to its upper end. Tubes are to be added only in the front and rear walls as a function of their increasing area in the upward direction along lower portion 126 of the separator.

Concerning the construction of wall 125B with tubes, two advantageous possibilities are offered.

The first one consists in providing in this wall only tubes that are connected, as to circulation of a heat transfer medium, to the tubes that are disposed in the other walls of the back pass. This possibility is cost effective.

The other possibility consists in having wall 125B equipped with tubes belonging to a series of heat exchange tubes for the walls of the back pass and with tubes belonging to a series of heat exchange tubes for the walls of the separator in the same manner as shown for wall 25B in FIG. 7.

Under outlet 128, the return duct 142 is built on side wall 164A, the upper part of which forms the common wall 125B between the back pass and the separator. The lower end of duct 142 is connected to seal pot 44 in the same way as lower end of duct 42 is connected to the seal pot in FIGS. 1 to 6.

The other separator 114' has a structure that is similar to that of separator 114 and is symmetrical with this separator with respect to a medium plane P.

Figure 10:
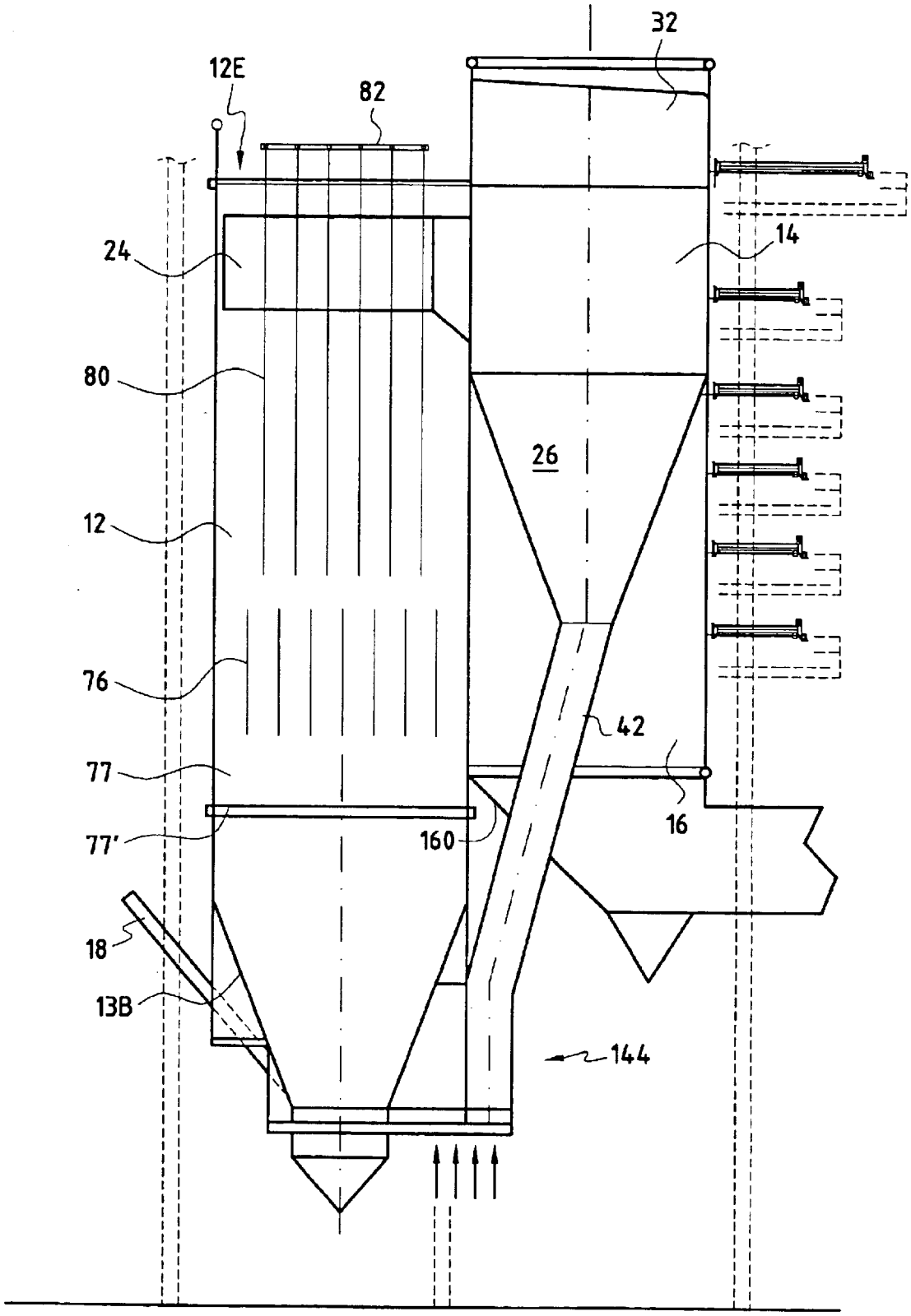
FIG. 10 shows another variant in a side view analogous to those of FIGS. 5 and 8.

In FIG. 10, the arrangement of the combustion chamber 12, the separator 14 and the back pass 16 is the same as in FIGS. 1 to 6.

The difference between the variant embodiment of FIG. 10 and those of the preceding figures resides in the fact that, in FIG. 10, the heat exchange area 48 is missing. In other words, there is no integrated bubbling bed under the back pass for a possible re-circulation of the particles coming down from separator 14.

The return duct 42 is connected to the lower part of chamber 12 via a seal pot or the like (144) that, in the example shown, is formed in a bottom part of duct 42 that is located adjacent an external wall (a side wall or the rear wall) of chamber 12.

Figure 11:
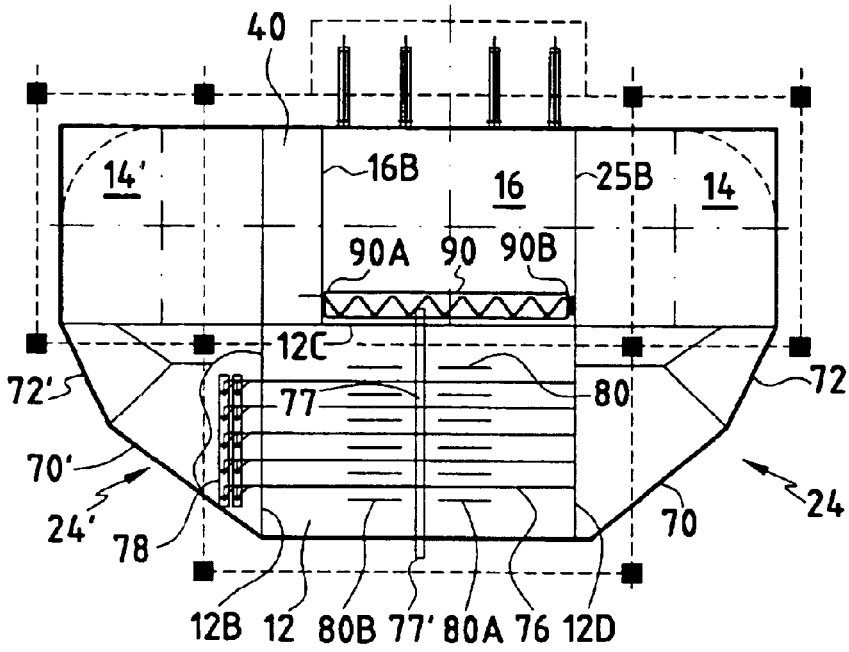
FIG. 11 is a top view of FIG. 10.

FIG. 10 shows another feature, that is also shown in FIG. 11 and that can be implemented in any variant embodiment of the invention.

According to this feature, combustion chamber 12 has heat exchanging means forming panels of this chamber, that comprise heat exchange tubes.

In the example, as more clearly shown in FIG. 11, these heat exchanging means comprise a series of panels 76 that extend across chamber 12 from side 12B to 12D thereof. For feeding the tubes of these heat exchanging means with a fluid transfer medium constituted by dry steam and for collecting the heat transfer medium of said tubes, feeding and collecting headers 78 are disposed next to chamber 12 (on one or both sides thereof), proximate one of its side walls 12B or 12D. In the example shown, the feeding and collecting headers are located adjacent wall 12B, under the acceleration duct 24'.

Besides performing heat transfer, the panels 76 could serve as stiffening means for the side walls 12B, 12D of chamber 12, as they extend vertically from one wall to the other. In order to avoid disturbing the flow of the fluidized bed of particles, the panels 76 suitably extend only over part of the height of chamber 12 (e.g. over one quarter of this height) and, for example, be located in a medium portion thereof, just above the area where the horizontal cross section of chamber 12 becomes constant in the upward direction.

In the advantageous example shown, the heat exchanging means in chamber 12 comprise another series of panels 80 which, for example, have a U shape with vertically extending branches 80A and 80B or a L shape.

These tubes are connected to feeding and collecting means (headers) 82 for the heat transfer medium circulating therein, that are located above roof 12E of chamber 12. The panels can have a U shape, in which case the headers 82 are located in a medium zone of roof 12E, or a L shape, in which case the headers 82 are located on a side of chamber 12.

The panels 80 extend in a central part of chamber 12 as seen in a horizontal cross section. They only extend over part of the length of chamber 12 as measured from side 12B to side 12D. They are located in an upper portion of this chamber, preferably above panels 76.

In the panels, the heat exchange tubes can be arranged so that one tube is fixed (e.g. welded) to the next one.

The adjacent tubes can also be separated by (web-like portions or be separated by slots.

FIGS. 10 and 11 also show a vertical wall 77, connected to feeding/collecting headers 77' and extending between the front wall and the rear wall of the reactor chamber, so as to divide said chamber totally or partly, in the upper area thereof, above the sloped wall 13B. Besides performing heat transfer due to its tube-fin-tube structure, wall 77 can serve as a stiffening means for the front and the rear walls 12A, 12C of chamber 12.

Figure 12:
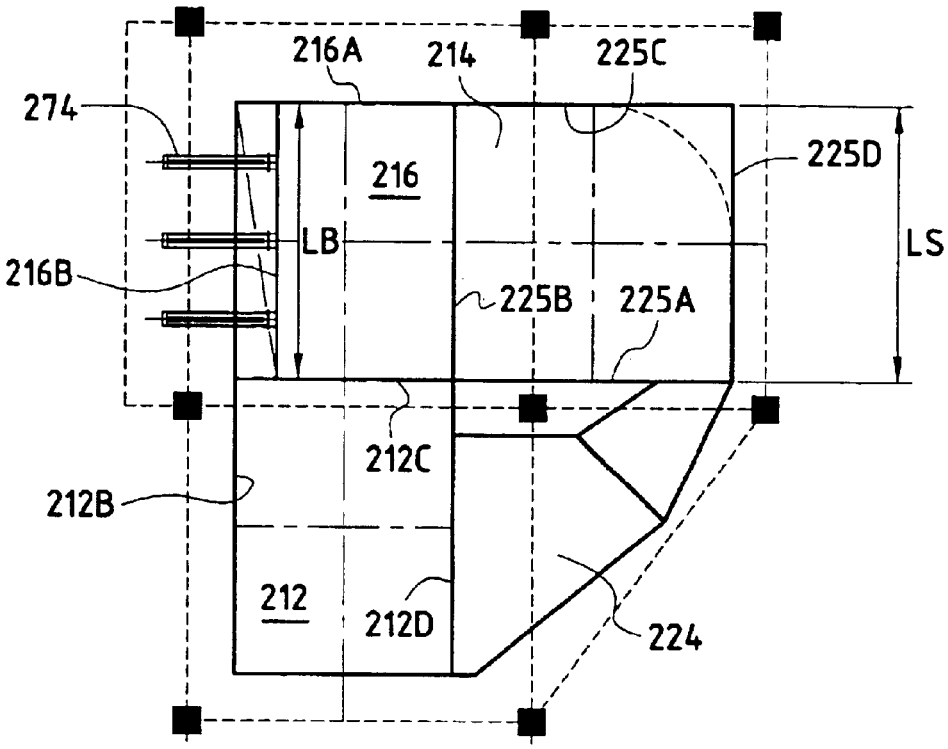
FIGS. 12 and 13 are top views of two further variant embodiments.
Figure 13:
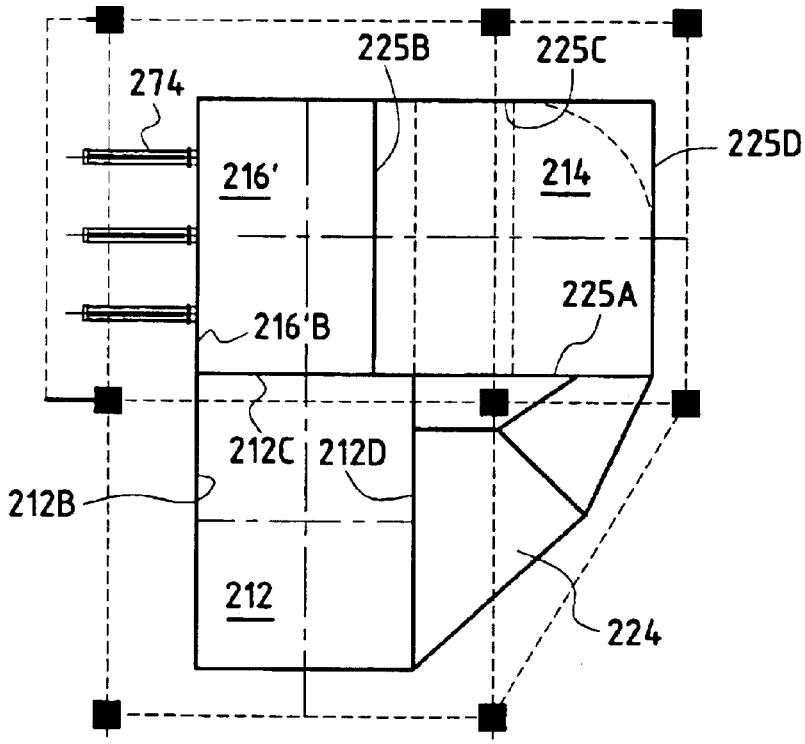

The top views of FIGS. 12 and 13 show that the fluidized bed reactor device of the invention can comprise one separator only instead of two separators as illustrated by the preceding drawings.

The combustion chamber 212, the separator 214 and the back pass 216 of FIG. 12 are disposed one with respect to the other, in the same way as chamber 12, separator 14 and back pass 16. In particular, chamber 212 has its rear wall 212C that is common with the front wall of back pass 216, and the separator 214 has its inner side wall 25B that is common with a side wall of the back pass 216. Although FIG. 12 shows the back pass and the separator having aligned rear walls, this is not necessarily the case and, for example, length LS of the separator can be smaller or greater than length LB of the back pass. This feature is also applicable to the configuration shown in FIG. 3. The soot blowing elements 274 can extend on the outer side of the back pass, as shown, but they can also extend behind the rear wall thereof.

Separator 214 can be similar to separators 14 or 114 of the preceding figures, and a heat exchanger area such as 48 of FIGS. 1 to 6 can be disposed or not under this separator.

In the example shown, the front and rear walls 225A, 225C of separator 214 are respectively formed as extensions of the front and rear walls 212C, 216A of the back pass, respectively aligned with these walls.

In FIG. 12, common wall 225B between the separator and the back pass is formed as an extension of side wall 212D of chamber 212 to which the acceleration duct 224, analogous to duct 24, is connected.

In this example, the soot blowing elements 274 for cleaning the heat exchanging surfaces in back pass 216 can be activated from the side wall 216B thereof that is disposed opposite to side wall 225B.

Feeding means and collecting means for a fluid transfer means that circulates in the tubes forming the said heat exchanging surfaces can also be disposed adjacent this side wall 216B or, in another alternative, adjacent to the rear wall 216A.

In the example of FIG. 13, the reactor device also comprises only one separator 214. In this example, rear wall 212C of the combustion chamber 212 is common to the front wall of the back pass and the inner side wall 225B of the separator is common to a side wall of the back pass. The common side wall 225B and the side wall 212D of the reactor chamber that is the closest to said common wall are parallel. The configuration of FIGS. 12 and 13 is also applicable to that of FIG. 3. However, wall 225B is not aligned with wall 212D, but is rather offset with respect thereto in the direction going from common wall 225B to the opposite wall 216'B of the back pass. Reciprocally, outer side wall 216'B of the back pass is aligned with the side wall 212B of chamber 212 that is disposed opposite to side wall 212D. Soot blowing elements 274 also cooperate with side wall 216'B or with the rear wall in an alternative arrangement.

FIG. 14 shows another embodiment of the invention, in which no external acceleration duct for conveying the mixture of particles and gas from the reactor chamber to the separator is provided.

In this example, two separators 314, 314' are respectively disposed on each side of the back pass 316, it is also possible that the reactor device comprises one separator only.

Considering first separator 314, it has a wall portion 325A1 that is common to the combustion chamber 312. More precisely, wall 312C of this chamber is a common wall between the chamber and the back pass 316. The chamber has a wall portion 312C1 that extends as an extension of this common wall 312C, and that is common to wall portion 325A1 of the separator. Inner side wall 325B of the separator (in the upper portion thereof), is offset with respect to outer side wall 312D of chamber 312 in a direction going from the outer side wall 325D of the separator to its inner side wall 325B.

One or several openings enabling gas to be dedusted to circulate from chamber 312 to separator 314 are formed in the common wall portion 312C1, 325A1 between the chamber and the separator.

Common wall 312C between chamber 312 and back pass 316 is the rear wall of the chamber and the front wall of the back pass.

A header box 40 is disposed between the side wall 316B of the back pass 316 that is situated opposite to common side wall 325B and the inner side wall 325'B of separator 314'. Wall 312C of chamber 312 has a wall portion 312C2, that is also one extension of common wall 312C and that forms a common wall portion between the combustion chamber and the back pass. The opening(s) for conveying the mixture of gas and particles from chamber 312 to separator 314' is (are) formed in this common wall portion 312C2.

Instead of providing the header box 40, it could be advantageous to locate some headers in the bottom part of the back pass (where the flue gas is at relatively low temperature of e.g. 450° C.) and the other headers above the back pass.

Since the two separators 314 and 314' are situated on each side of the back pass, the wall portions 312C1 and 312C2 are disposed at each lateral end of wall 312C.

The structure of FIG. 14 has the advantage of being even compacter than the structure of the preceding figures that presents external acceleration ducts. It can comprise one separator only.

In FIGS. 1 to 6, 8, 9, 11 and 14, it is clear that the reactor device of the invention comprises two separators, but one combustion chamber only and one back pass only.

It is also possible to foresee a modular arrangement of several reactor devices, so as to constitute different installations of reactor devices having different powers and capacities, starting from the same modules.

Thus, an installation of circulating fluidized bed reactor can comprise at least two coupled reactor devices as described above.

In an example, the two reactor devices can be coupled by a coupling wall which, for each device, is formed by a side wall of the reactor chamber of the device and by a side wall of the back pass of the device which is disposed opposite to the common side wall between the back pass and the separator of the device. In such case, each device comprises one separator on an outer side or its back pass, but no separator is situated on the other side thereof, so as to authorize the coupling by this coupling wall.

Thus, advantageously, the side wall of the reactor chamber and the side wall the back pass that belongs to said coupling wall are aligned.

In a variant embodiment, the two reactor devices are coupled at a coupling wall which, for each device, is formed by a front wall of the reactor chamber of the device which is disposed opposite to the common side wall between said reactor chamber and the back pass of the device.

In another variant, the two devices are coupled at a coupling wall which, for each device, comprises a rear wall of the back pass which is disposed opposite to the common side wall between said reactor chamber and the back pass of the device. This coupling wall can also comprise a rear wall of the separator that is aligned with said rear wall of the back pass.

In all these cases, the coupling wall can be avoided totally or partially in same areas if adapted. Where not suppressed, the coupling wall can have a single or a double wall structure, with or without intermediate stiffening means.

In such installations of fluidized bed reactor devices, the particles inlets in the reactor chambers and the headers can be arranged in an adapted manner. For example, should two reactor devices be coupled by the front faces of their respective reactor chambers, the particles inlets could be disposed as inlets 18' or 18" of FIG. 6. If two reactor devices are coupled by the rear walls of their respective back passes, then the outlets for the flue gas of these back passes can be formed laterally.

Figure 15:
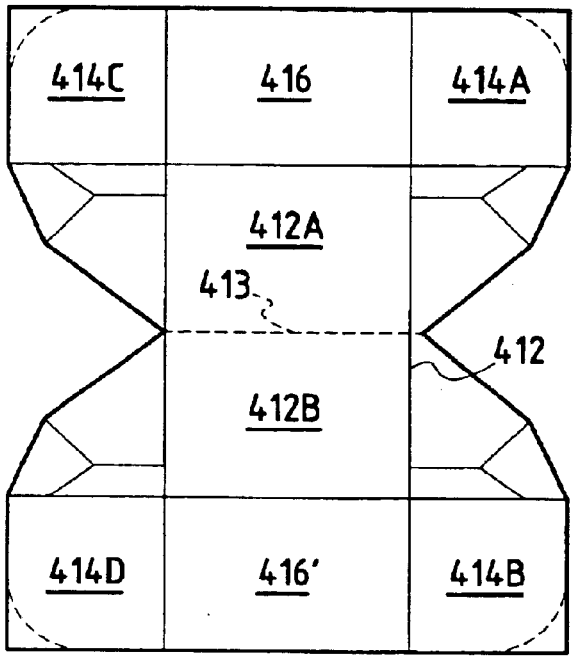
FIGS. 15 and 16 are top views of reactor devices according to a further embodiment of the invention.

FIG. 15 shows a reactor device having a reactor chamber 412, a first back pass 416 located behind the chamber, a second back pass 416' located at the front of the chamber, a separator 414A connected to back pass 416 and to chamber 412, and a separator 414B connected to back pass 416' and to chamber 414B. In the example shown, two further separators, 414C and 414D, are foreseen and are connected to chamber 412 and to the back passes 416 and 416' respectively. Indeed separators 414A and 414C are located on each side of back pass 416. They can both have their side walls in common with the side walls of this back pass or, as in FIG. 3, a header box can be located between one of separators 414A and 414C, and back pass 416. The same applies to separators 414B and 414D, with respect to back pass 416'. Chamber 412 can have its front and rear walls in common with, respectively, back pass 416' and back pass 416, or else a header box can be located between chamber 412 and back pass 416'. In the example of FIG. 15, solids can be fed into chamber 412 via the side walls thereof (for example via inlets such as inlets 18' and 18" of FIG. 6), and the flue gas can escape the back passes 416 and 416' through respective rear and front walls thereof.

Chamber 412 can be divided in two reactor chambers 412A and 412B, by a wall 413 as shown in dot and dash lines. In this case, wall 413 is a coupling wall that couples the respective reactor devices (412A, 416, 414A, 414B) and (412B, 416', 414B, 414D). Alternatively, chamber 412 can be divided only in the upper part thereof, by a partition such as partition wall 77 of FIG. 10.

Figure 16:
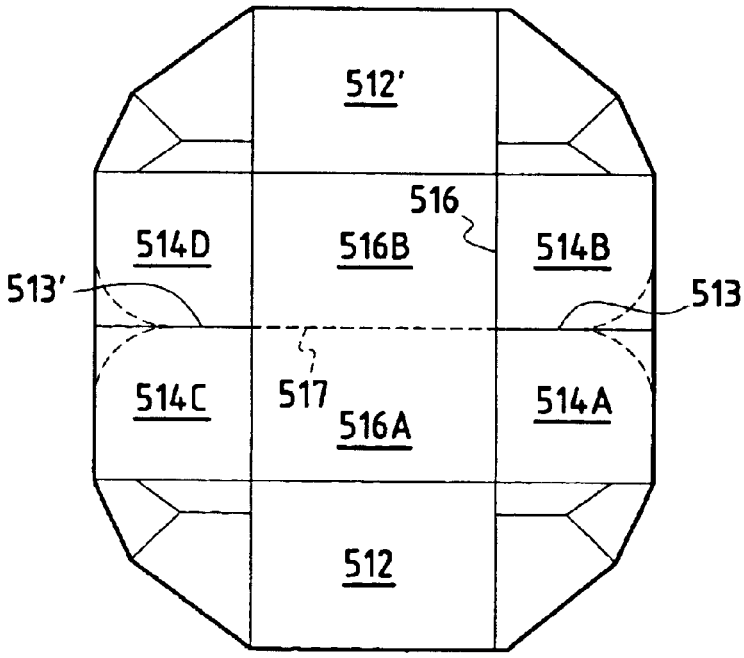

FIG. 16 shows a reactor device having a back pass 516, a first reactor chamber 512 located at the front of back pass 516, a second reactor chamber 512', located behind the back pass 516, a first separator 514A, connected to chamber 512 and to back pass 516, and a second separator 514B, connected to chamber 512' and to the back pass.

In the example shown, two further separators, 514C and 514D, are foreseen and are connected to back pass 516 and, respectively, to chambers 512 and 512'. In fact, separators 514A and 514C are located on the respective sides of back pass 516, as are separators 514B and 514D. Separators 514A and 514B can have their respective rear and front walls in common, as separators 514C and 514D can have. A header box can be disposed on one side of the back pass, between the back pass and the separator(s) located on this side. Solids can be fed into the chambers 512 and 512' via their respective front and rear walls, and/or via their side wall (for example via inlets, such as inlets 18' and 18" of FIG. 6). The flue gas can escape the back pass via one side or both sides thereof, through openings located under the separators.

Back pass 516 can be divided in two back passes, 516A and 5156B, by a wall 517 as shown in dot and dash lines. In this case, wall 517 is a coupling wall that couples the respective reactor devices (512, 516A, 514A, 514C) and (512', 516B, 514B, 514B).

The coupling wall can include coupling walls 513, 513' of, respectively, separators 514A and 514B, and separators 514C and 514D.

In FIGS. 15 and 16, the separators can be connected to the reactor chamber(s) via acceleration ducts as shown.

In FIGS. 3, 11 and 14, a wall of the reactor device (in the present case, the common wall 12C or 312C between the reactor chamber 12 or 312 and the back pass 16 or 316) is stiffened by stiffening means that comprise a truss beam 90 extending along this stiffened wall 12C or 312C and having its ends 90A, 90B respectively connected to wall 16B or 316B and to wall 25B or 325B, between which wall 12C or 312C extends and that form supporting walls for the beam.

Figure 17:
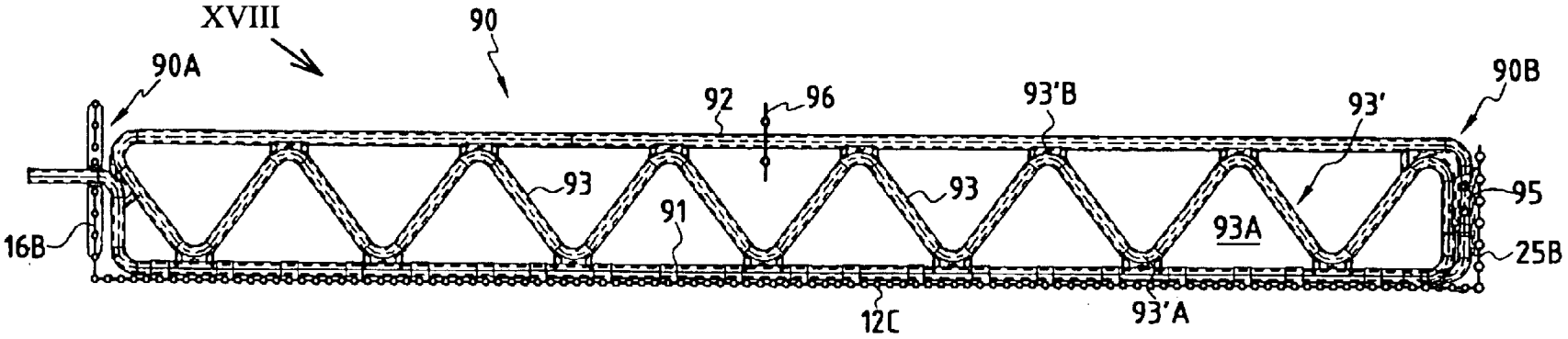
FIG. 17 is a partial horizontal section showing a stiffened wall of the device and the stiffening means for said wall.
Figure 18:
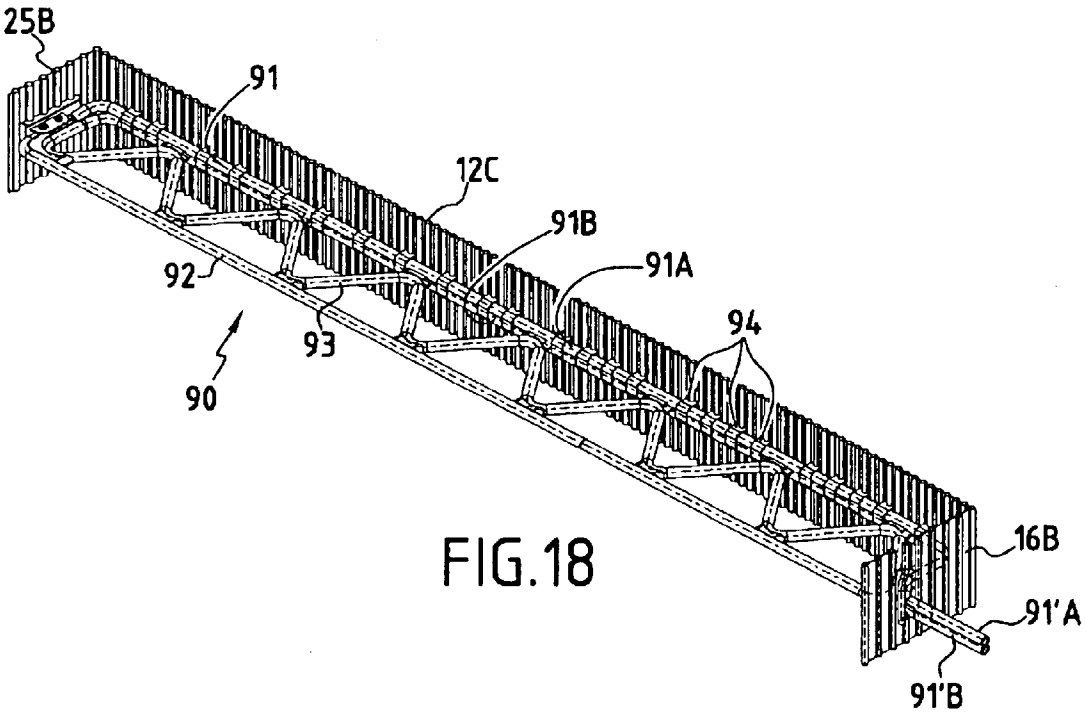
FIG. 18 is a perspective view according to arrow XVIII of FIG. 17 showing only a portion of the stiffened wall.

As shown in more details in FIGS. 17 and 18, the truss beam 90 comprises a first elongate member 91 disposed against wall 12C and a second elongate member 92, spaced from the first elongate member by spacing members 93. The flow of a gas and/or gas and particles can go through the spaces 93A delimited between the spacing members without significant disturbance.

In the advantageous embodiment shown, the truss beam has a tube structure, allowing the circulation of a heat transfer medium therein.

In the present case, the truss beam 90 is even formed of tubes that communicate between them. More precisely, it comprises a tube having a first portion 91A that is connected to a heat transfer medium inlet 91'A and that extends along wall 12C, from wall 16B to wall 25B, said first tube portion being rectilinear, a second tube portion 92 that is connected to the end of said first tube portion 91A close to wall 25B and that extends as a rectilinear tube portion from wall 25B to wall 16B at a distance from wall 12C, a third portion 93', that is connected to said second portion 92 at the corner between walls 12C and 16B and that goes to wall 25B while presenting undulations that form said spacing members 93 (said third portion extending horizontally, substantially in a plane containing said first and second portions), and a fourth tube portion 91B, connected to said third tube portion 93 at the corner between walls 12C and 25B, said fourth tube portion 91B going back from wall 25B to wall 16B, being disposed adjacent said first tube portion 91A, and being connected to a heat transfer medium outlet 91'B.

This arrangement of the tube portions is given by way of example. Some other tube arrangements would also be possible with one or several heat transfer medium inlet(s) and outlet(s).

The first and fourth tube portions 91A, 91B, considered together, form the first elongate member 91, whereas the third tube portion 92 forms the second elongate member of the truss beam.

The first elongate member 91, which is in contact with the stiffened wall, is highly resistant to deflection stresses since it comprises two adjacent rectilinear tube portions 91A and 91B. These tube portions are advantageously disposed one above the other and are attached to wall 12C by fastening bows 94 that allow a respective sliding movement between the truss beam and wall 12C. For example, the fastening bows 94 have their ends welded to wall 12C, whereas tube portions 91A and 91B can slide in said bows.

At its end 90B, the truss beam is fastened to wall 25B by a brace 95. As its opposite end 90A, the beam is secured to wall 16B by the fact that said heat transfer medium inlet 91'A and outlet 91'B go through this wall, without being welded thereto. This enables that the respective lengths of wall 12C and of beam 90 react differently to temperature gradients, without any buckling of wall 12C.

At their respective inner ends 93'A (close to wall 12C) and at their outer ends 93'B (close to elongate member 92), the spacing members 93 are respectively welded to elongate member 91 or 92, or fastened thereto by any convenient fastening means such as fastening plates.

The truss beam extends horizontally against wall 12C. In order to avoid any deflection of elongate member 92 in a vertical plane, this member can be supported by supports 96 located at one or several places along its length, for example, as shown, in a medium region of said member. These supports can be connected to the roof or to the bottom of the enclosure where the beam is located, and extend vertically.

This enclosure is advantageously the back pass, in which case the supports 96 preferably also contribute to supporting the heat exchangers disposed in said enclosure.

Figure 19:
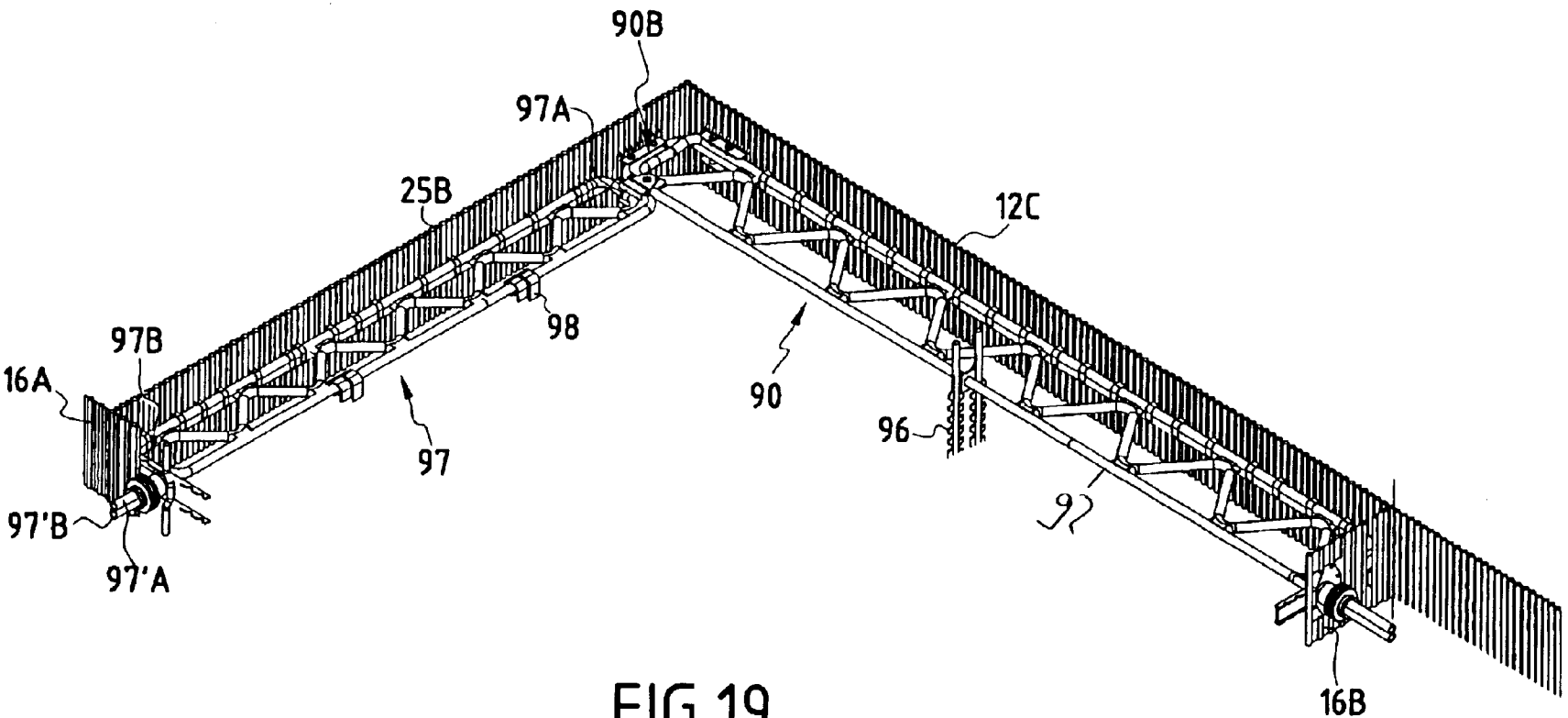
FIG. 19 is a view similar to that of FIG. 18, showing a variant embodiment.

In FIG. 19, an additional truss beam 97 stiffens wall 25B. For the stiffening of wall 25B, the supporting walls that support the ends of the beam 97 are respectively wall 12C and wall 16A (see FIG. 3). In the present case, end 97A of beam 97 is indirectly supported by wall 12C, via beam 90, to the end 90B of which it is fastened. The opposite end 97B of beam 97 is supported by wall 16A as is end 90A of beam 90 by wall 16B.

In the present case, beams 90 and 97 are not directly connected as far as circulation of the heat transfer medium is concerned, the medium inlet and outlet 97'A, 97'B for beam 97 going through wall 16A. In an alternative embodiment, such a direct connection would be possible while having, for example, the first tube portion 91A of beam 90 being curved at the corner between walls 12C and 25B so as to form the first tube portion of beam 97, the second tube portions of the beams forming a single tube curved at a right angle at the corner between walls 12C and 25B, and so on . . .

The second elongate member of beam 97 is suited with supporting bows 98 that can provide for an intermediate support of said member while resting on supporting elements that can be formed by the heat exchangers if the beam is located in the back pass.

Although it is advantageous that the stiffening means described with reference to FIGS. 17 to 19 be located in the back pass, some other enclosures of the reactor device could be provided with similar stiffening means, provided that they are corrosion and wear resistant to a flow of particles and gas if they are located in the separator(s) or in the reactor chamber(s).

The truss beam is rectilinear when, as it is preferably the case, the stiffened wall is a planar wall. Furthermore, the supporting walls preferably extend perpendicularly with respect to the stiffened wall.

What is claimed is:

1. A circulating fluidized bed reactor device comprising a reactor chamber delimited horizontally by walls, a centrifugal separator and a back pass for heat recovery, the reactor device comprising means for introducing a fluidizing gas into the reactor chamber and for maintaining a fluidized bed of particles in said chamber, means for transferring gas to be dedusted from the reactor chamber into the separator, means for discharging separated particles from the separator and means for transferring dedusted gas from the separator into the back pass, the latter having a common wall with the reactor chamber, -and the separator having a side wall which is a common wall with a side wall of the back pass.

2. A reactor device as claimed in claim 1, wherein said common walls are planar walls.

3. A reactor device as claimed in claim 1 wherein said common walls form between them a substantially right angle.

4. A reactor device as claimed in claim 1, wherein the common wall between the back pass and the reactor chamber is the front wall of the back pass and wherein the separator has a front wall disposed as an extension of said front wall of the back pass.

5. A reactor device as claimed in claim 1, wherein the separator has a rear wall disposed as an extension of the rear wall of the back pass, opposed to said front wall thereof.

6. A reactor device as claimed in claim 1, wherein the side wall which is common between the separator and the back pass is disposed as an extension of a side wall of the reactor chamber.

7. A reactor device as claimed in claim 1, wherein the side wall which is common between the separator and the back pass is offset, in a direction going from said common wall to an opposite wall of the back pass, with respect to the side wall of the reactor chamber that is the closest to said common wall.

8. A reactor device as claimed in claim 1, wherein the means for transferring dedusted gas from the separator into the back pass comprise an opening formed in a side wall of the back pass which is an upper extension of the common wall between the separator and the back pass.

9. A reactor device as claimed in claim 8, wherein said side wall of the back pass comprises heat exchange tubes in which a fluid transfer medium can pass and in that said opening is formed in this side wall by bent portions of said tubes.

10. A reactor device as claimed in claim 1, wherein the side wall which is common between the separator and the back pass comprises heat exchange tubes that are connected to a series of heat exchange tubes in other walls of the separator and tubes that are connected to a series of heat exchange tubes in other walls of the back pass, the tubes of the two series being intercalated in said common side wall.

11. A reactor device as claimed in claim 1, wherein the means for transferring gas to be dedusted from the reactor chamber into the separator comprise an acceleration duct which extends between a wall of the reactor chamber in which an outlet for gas to be dedusted is formed and a wall of the separator in which an inlet for gas to be dedusted is formed, said acceleration duct having a cross section which decreases in a direction going from said outlet to said inlet.

12. A reactor device as claimed in claim 11, wherein the wall of the reactor chamber in which said outlet is formed is a side wall of said chamber and wherein the separator wall in which said inlet is formed is a front wall of the separator.

13. A reactor device as claimed in claim 11, wherein the acceleration duct comprises a first part connected to said wall of the reactor chamber in which said gas outlet is formed and a second part connected to said wall of the separator in which said gas inlet is formed, said first and second parts being connected together at a knee of the acceleration duct and presenting substantially planar walls.

14. A reactor device as claimed in claim 13, wherein the first part of the acceleration duct has a decreasing cross section towards the knee, whereas the second part of said duct has a cross section that remains substantially constant from the knee to the gas inlet.

15. A reactor device as claimed in claims 13, wherein the second part of the acceleration duct has a lower wall that is inclined downwardly in a direction going towards the front wall of the separator.

16. A reactor device as claimed in claim 13, wherein the walls of the reactor chamber and the walls of the separator comprise heat exchange tubes in which a heat transfer medium can pass and wherein tubes of the chamber walls are bent so as to extend in the walls of said first part of said acceleration duct and tubes of the separator wall are bent so as to extend in the walls of said second part of said duct.

17. A reactor device as claimed in claim 1, wherein the reactor chamber has a wall portion, that extends as an extension of said common wall between the reactor chamber and the back pass and that is common to a wall portion of the separator, and wherein an opening enabling gas to be dedusted to circulate from the chamber to the separator is formed in said common wall portion.

18. A reactor device as claimed in claim 1, wherein the reactor chamber has heat exchanging means forming panels of said chamber that comprise heat exchange tubes extending in said chamber from at least one wall thereof.

19. A reactor device as claimed in claim 18, wherein at least part of said panels are connected to said wall of the reactor chamber which is common with the back pass and form stiffening means for said common wall.

20. A reactor device as claimed in claim 1 comprising at least one stiffened wall that extends between two supporting walls and that is stiffened by stiffening means comprising a truss beam extending along said stiffened wall and having respective ends that are respectively supported by said supporting walls.

21. A reactor device as claimed in claim 20, wherein the truss beam is attached to the stiffened wall by attaching mans allowing a relative sliding between said beam and said wall.

22. A reactor device as claimed in claim 20, wherein the truss beam is composed of at least a first elongate beam member located against the stiffened wall, a second elongate member, parallel to said first beam member and spaced therefrom, and a plurality of spacing members, defining spaces between them and connecting said first and second elongate beam members.

23. A reactor device as claimed in claim 20, wherein the truss beam has a tube structure formed of tubes allowing a circulation of a heat transfer medium therein.

24. A reactor device as claimed in claim 1, comprising two separators respectively disposed adjacent the side walls of the back pass.

25. A reactor device as claimed in claim 24, comprising a reactor chamber, a first back pass located behind said chamber, a second back pass located in front of said chamber and at least a first and a second separators connected to the reactor chamber and, respectively, to said first and second back pass.

26. A reactor device as claimed in claim 24, comprising a back pass, a first and a second reactor chamber, respectively located in front of the back pass and behind said back pass, and at last a first and a second separator, connected to the back pass and, respectively, to said first and second reactor chambers.

27. An installation of a circulating fluidized bed reactor, comprising at least two coupled reactor devices, each one of which comprises a reactor chamber delimited horizontally by walls, a centrifugal separator and a back pass for heat recovery, means for introducing a fluidizing gas into the reactor chamber and for maintaining a fluidized bed of particles in said chamber, means for transferring gas to be dedusted from the reactor chamber into the separator, means for discharging separated particles from the separator and means for transferring dedusted gas from the separator into the back pass, wherein, in each reactor device, the back pass has a common wall with the reactor chamber and the separator has a side wall which is a common wall with a side wall of the back pass.

28. An installation as claimed in claim 27, wherein the two reactor devices are coupled by a coupling wall which, for each device, is formed by a side wall of the reactor chamber of the device and by a side wall of the back pass of the device which is disposed opposite to the common side wall between the back pass and the separator of the device.

29. An installation as claimed in claim 28, wherein, for each device, the side wall of the reactor chamber and the side wall the back pass that belong to said coupling wall are aligned.

30. An installation as claimed in claim 27, wherein the two reactor devices are coupled at a coupling wall which, for each device, is formed by a front wall of the reactor chamber of the device which is disposed opposite to the common side wall between said reactor chamber and the back pass of the device.

31. An installation as claimed in claims 27, wherein the two reactor devices are coupled at a coupling wall which, for each device, comprises a rear wall of the back pass which is disposed opposite to the common side wall between said reactor chamber and the back pass of the device.

32. An installation as claimed in claim 31, wherein, for each reactor device, the coupling wall comprises a rear wall of the separator that is aligned with said rear wall of the back pass.

33. An installation as claimed in claim 27, wherein, in each reactor device, the means for transferring gas to be dedusted from the reactor chamber into the separator comprise an acceleration duct which extends between an outlet of the reactor chamber and an inlet of the separator, said acceleration duct having a cross section that decreases in a direction going from said outlet to said inlet.

34. An installation as claimed in claim 27, wherein each reactor device comprises at least one stiffened wall that extends between two supporting walls and that is stiffened by stiffening means comprising a truss beam extending along said stiffened wall and having respective ends that are respectively supported by said supporting walls.

35. A circulating fluidized bed reactor device comprising a reactor chamber delimited horizontally by walls, a centrifugal separator and a back pass for heat recovery, the reactor device comprising means for introducing a fluidizing gas into the reactor chamber and for maintaining a fluidized bed of particles in said chamber, means for transferring gas to be dedusted from the reactor chamber into the separator, means for discharging separated particles from the separator and means for transferring dedusted gas from the separator into the back pass, the separator having a side wall which is a common wall with a side wall of the back pass, wherein the means for transferring dedusted gas from the separator into the back pass comprise an opening formed in a side wall of the back pass which is an upper extension of the common wall between the separator and the back pass.

36. A circulating fluidized bed reactor device comprising a reactor chamber delimited horizontally by walls, a centrifugal separator and a back pass for heat recovery, the reactor device comprising means for introducing a fluidizing gas into the reactor chamber and for maintaining a fluidized bed of particles in said chamber, means for transferring gas to be dedusted from the reactor chamber into the separator, means for discharging separated particles from the separator and means for transferring dedusted gas from the separator into the back pass, the separator having a side wall which is a common wall with a side wall of the back pass, wherein the side wall which is common between the separator and the back pass comprises heat exchange tubes that are connected to a series of heat exchange tubes in other walls of the separator and tubes that are connected to a series of heat exchange tubes in other walls of the back pass, the tubes of the two series being intercalated in said common side wall.

37. A circulating fluidized bed reactor device comprising a reactor chamber delimited horizontally by walls, a centrifugal separator and a back pass for heat recovery, the reactor device comprising means for introducing a fluidizing gas into the reactor chamber and for maintaining a fluidized bed of particles in said chamber, means for transferring gas to be dedusted from the reactor chamber into the separator, means for discharging separated particles from the separator and means for transferring dedusted gas from the separator into the back pass, the separator having a side wall which is a common wall with a side wall of the back pass, wherein the means for transferring gas to be dedusted from the reactor chamber into the separator comprise an acceleration duct which extends between a wall of the reactor chamber in which an outlet for gas to be dedusted is formed and a wall of the separator in which an inlet for gas to be dedusted is formed, said acceleration duct having a cross section which decreases in a direction going from said outlet to said inlet.

38. A reactor device as claimed in claim 37, wherein the acceleration duct comprises a first part connected to said wall of the reactor chamber in which said gas outlet is formed and a second part connected to said wall of the separator in which said gas inlet is formed, said first and second parts being connected together at a knee of the acceleration duct and presenting substantially planar walls.

39. A reactor device as claimed in claim 38, wherein the first part of the acceleration duct has a decreasing cross section towards the knee, whereas the second part of said duct has a cross section that remains substantially constant from the knee to the gas inlet.

40. A reactor device as claimed in claim 38, wherein the walls of the reactor chamber and the walls of the separator comprise heat exchange tubes in which a heat transfer medium can pass and wherein tubes of the chamber walls are bent so as to extend in the walls of said first part of said acceleration duct and tubes of the separator wall are bent so as to extend in the walls of said second part of said duct.

* * * * *